US010869532B2

(12) United States Patent
Tani

(10) Patent No.: US 10,869,532 B2
(45) Date of Patent: Dec. 22, 2020

(54) APPLICATION CONTAINER

(71) Applicant: TOKIWA CORPORATION, Nakatsugawa (JP)

(72) Inventor: Yoshikazu Tani, Kawaguchi (JP)

( * ) Notice: Subject to any disclaimer, the term of this patent is extended or adjusted under 35 U.S.C. 154(b) by 20 days.

(21) Appl. No.: 16/254,110

(22) Filed: Jan. 22, 2019

(65) Prior Publication Data

US 2019/0223576 A1 Jul. 25, 2019

(30) Foreign Application Priority Data

Jan. 23, 2018 (JP) ..... 2018-008829

(51) Int. Cl.
*A46B 17/08* (2006.01)
*A45D 34/04* (2006.01)

(52) U.S. Cl.
CPC ..... *A45D 34/046* (2013.01); *A45D 34/04* (2013.01)

(58) Field of Classification Search
CPC ..... A45D 34/06; A45D 34/046; A45D 40/24; A45D 40/06; A45D 40/065; A45D 40/267
USPC ..... 401/121, 75
See application file for complete search history.

(56) References Cited

U.S. PATENT DOCUMENTS

| | | | | |
|---|---|---|---|---|
| 6,270,273 | B1 | 8/2001 | Ohba | |
| 7,845,871 | B2 * | 12/2010 | Thiebaut | A45D 34/06 132/314 |
| 2009/0028627 | A1 | 1/2009 | Gueret | |
| 2017/0303663 | A1 * | 10/2017 | Kim | A45D 40/24 |

FOREIGN PATENT DOCUMENTS

| | | |
|---|---|---|
| JP | S60-151421 | 10/1985 |
| JP | H9-070314 | 3/1997 |
| JP | H10-174613 | 6/1998 |
| JP | H11-244043 | 9/1999 |
| JP | 2999135 | 1/2000 |
| JP | 2000-037227 | 2/2000 |
| JP | 2016-220972 | 12/2016 |
| KR | 20-0365067 | 10/2004 |

* cited by examiner

*Primary Examiner* — Jennifer C Chiang
(74) *Attorney, Agent, or Firm* — Soei Patent & Law Firm

(57) ABSTRACT

An application container includes a cylindrical filling unit and a cover. The cover has a female screw formed at one end of the cover in the axial direction. The application container includes a main body that has an application tool that is configured to be inserted into the filling unit, and a male screw that is configured to be screwed into the female screw. Additionally, the application container includes a soft material wiper that is fixed to the opening of the filling unit. The wiper has a first protruding portion which protrudes outward from the opening in a radial direction of the filling unit to contact an inner surface of the cover. The first protruding portion is interposed in the axial direction between a wall portion disposed on the inner surface of the cover and the end of the filling unit which includes the opening.

19 Claims, 21 Drawing Sheets

APPLICATION CONTAINER

CROSS-REFERENCE TO RELATED APPLICATIONS

This application claim priority to Japanese Patent Application No. P2018-008829, filed Jan. 23, 2018, the entire contents of which are incorporated herein by reference.

TECHNICAL FIELD

Application containers and application tools.

BACKGROUND

Japanese Unexamined Patent Publication No. 10-174613 discloses a liquid cosmetic material application container for accommodating a liquid cosmetic material. The liquid cosmetic material application container includes a main body having an application tool, and a lid body having a tank filled with the liquid cosmetic material to be adhered to the application tool. A male screw is formed on an outer surface of the main body, and a female screw is formed on an inner surface of the lid body. The male screw is screwed into the female screw, thereby attaching the main body to the lid body.

An opening of the tank in the lid body has a cylindrical sealing member for sealing the tank. The sealing member includes a flange portion protruding outward in a radial direction. The sealing member is fixed to an interior of the lid body by interposing the flange portion between the opening of the tank and a compression coil spring. The sealing member is made of synthetic rubber, and internally has a through-hole having a substantially funnel shape. The application tool of the main body is inserted into the through-hole. In addition, if the application tool is inserted into the through-hole, an application tool holder located in a base of the application tool comes into contact with an outer edge of the through-hole. The through-hole is sealed with the sealing member by the application tool holder coming into contact with the outer edge of the through-hole.

Japanese Unexamined Patent Publication No. H9-70314 discloses a liquid cosmetic material application container. The liquid cosmetic material application container includes a hollow shaft cylinder whose leading end has an application tool and which extends in a bar shape, and a lid body that can be attached to the shaft cylinder by covering the application tool. In the liquid cosmetic material application container, a female screw formed on an inner surface of the lid body is screwed to a male screw formed on an outer surface of the shaft cylinder, thereby attaching the lid body to the shaft cylinder.

The lid body includes a cartridge-type tank for accommodating the liquid cosmetic material, and a cylindrical body combined with the cartridge-type tank. The application tool is inserted into the cartridge type tank. The cylindrical body internally has a liquid cosmetic material sealing member serving as a synthetic rubber-made packing having a small hole into which the application tool is inserted. The liquid cosmetic material sealing member includes a peripheral ridge and a flange portion which are formed on an outer peripheral surface. The peripheral ridge of the liquid cosmetic material sealing member engages with a peripheral groove of the cartridge-type tank, and the flange portion is biased against the cartridge-type tank side by a compression coil spring. Thereby the liquid cosmetic material sealing member is fixed to an interior of the cylindrical body.

SUMMARY

The liquid cosmetic material sealing member functions as a cylindrical wiper which wipes off a liquid cosmetic material excessively adhering to the application tool when the application tool is pulled out from the tank. The peripheral ridge of the wiper engages with the peripheral groove of the tank, and the flange portion is biased against the tank side by the compression coil spring. In a case where the wiper is biased against the tank side by the compression coil spring, and since the wiper is formed of a soft material such as synthetic rubber, when a force acting in an axial direction is applied to the wiper, the wiper is deformed. Consequently, there is a possibility that the wiper may fall into the tank. In this way, when the force is applied to the wiper in the axial direction, the wiper may be detached.

Example application containers which can prevent a wiper from being detached are disclosed herein.

An example application container includes a cylindrical shaped filling unit having a closed bottom in one end and that has an opening in the other end in an axial direction, and a cover that has a cylindrical shape for accommodating the filling unit, and that has a female screw formed on one end side of an inner surface in the axial direction. Additionally, the application container may include a main body that has an application tool to be inserted into the filling unit, and a male screw to be screwed into the female screw, and a soft material-made wiper to be fixed to the opening of the filling unit and the inner surface of the cover. The wiper has a first protruding portion which protrudes outward in a radial direction. The first protruding portion is interposed in the axial direction between a wall portion to be disposed on the inner surface of the cover and an end portion on the opening side of the filling unit.

In the application container, the cylindrical filling unit having the opening in the end in the axial direction is accommodated in the cylindrical cover, thereby appearing as a double cylindrical shape. The female screw is formed on the one end side of the inner surface of the cover in the axial direction, and the male screw is formed in the main body having the application tool to be inserted into the filling unit. In a state where the application tool is inserted into the filling unit, the male screw of the main body is screwed into the female screw of the inner surface of the cover, thereby mounting the main body on the cover. The soft material-made wiper is fixed to the opening of the filling unit and the inner surface of the cover. The wiper includes the first protruding portion which protrudes outward in the radial direction. In addition, the inner surface of the cover has the wall portion, and the first protruding portion of the wiper is interposed in the axial direction between the wall portion and the end portion on the opening side of the filling unit. The first protruding portion is fixed in an interposed state in the axial direction between the wall portion of the inner surface of the cover and the end portion on the opening side of the filling unit. Therefore, the first protruding portion of the wiper is interposed in the axial direction between the wall portion of the inner surface of the cover and the end portion of the filling unit. Accordingly, a configuration can be adopted in which a force acting in the axial direction is less likely to be applied to the first protruding portion of the wiper. As a result, a position of the wiper may be prevented from being misaligned with the inner surface of the cover and the filling unit. Therefore, the wiper may be prevented from being detached.

The wiper may have a second protruding portion which protrudes in the axial direction from a surface on the wall portion side. In this case, the second protruding portion enters the wall portion in the axial direction. Therefore, the second protruding portion may be prevented from slipping out of the wall portion. Accordingly, the wiper may be reliably prevented from being detached.

A plurality of the wall portions may be disposed on the inner surface of the cover along a circumferential direction. In this case, the first protruding portion of the wiper can be interposed between a plurality of the wall portions and the end portion of the filling unit. Therefore, even in a case where a plurality of the wall portions are intermittently formed along the circumferential direction, the wiper may be reliably prevented from being detached.

The application container may further include a bar-shaped application material that extends in the axial direction on a side opposite to the application tool of the main body. The main body may include a feeding mechanism which feeds the bar-shaped application material in the axial direction. In this case, the filling unit is internally filled with a liquid or powder application material, and the application container includes the bar-shaped application material. Accordingly, one application container can be provided with a plurality of application material types. The main body includes the feeding mechanism which feeds the bar-shaped application material on the side opposite to the application tool of the main body. In this manner, the bar-shaped application material can be fed to the side opposite to the application tool.

Accordingly, the wiper may be prevented from being detached.

DETAILED DESCRIPTION

Figure 1:
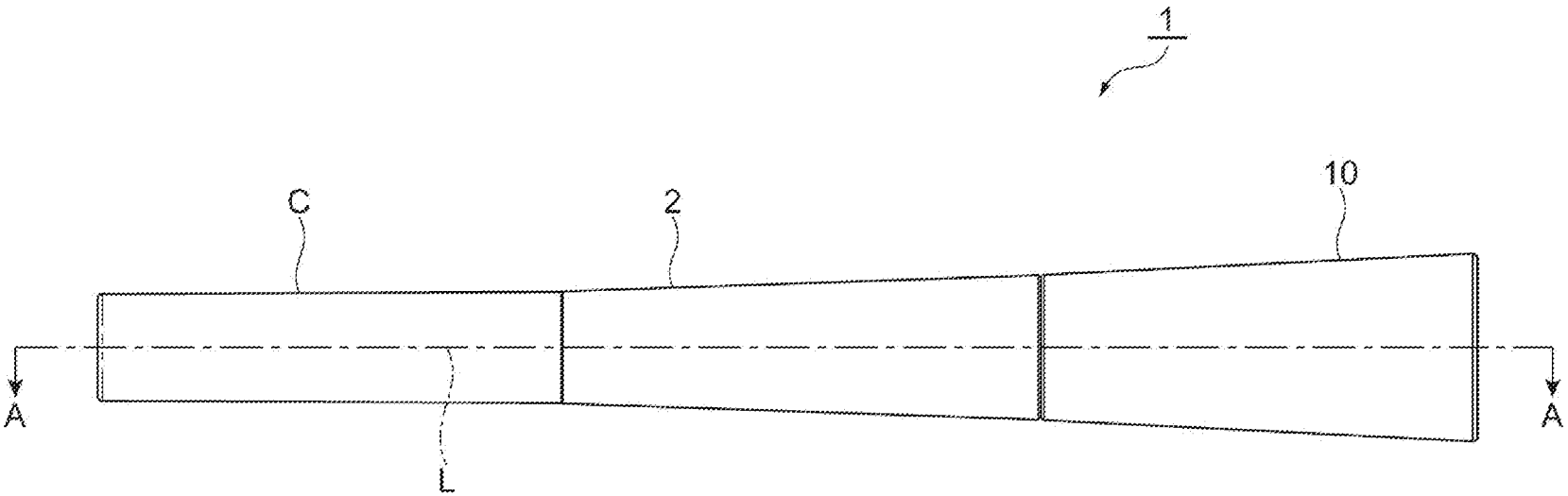
FIG. 1 is a side view illustrating an example application container according to a first group of embodiments.

Hereinafter, embodiments of an application container will be described with reference to the drawings. In describing the drawings, the same reference numerals will be given to the same or equivalent elements, and repeated description will be appropriately omitted.

First Group of Embodiments

Figure 2:
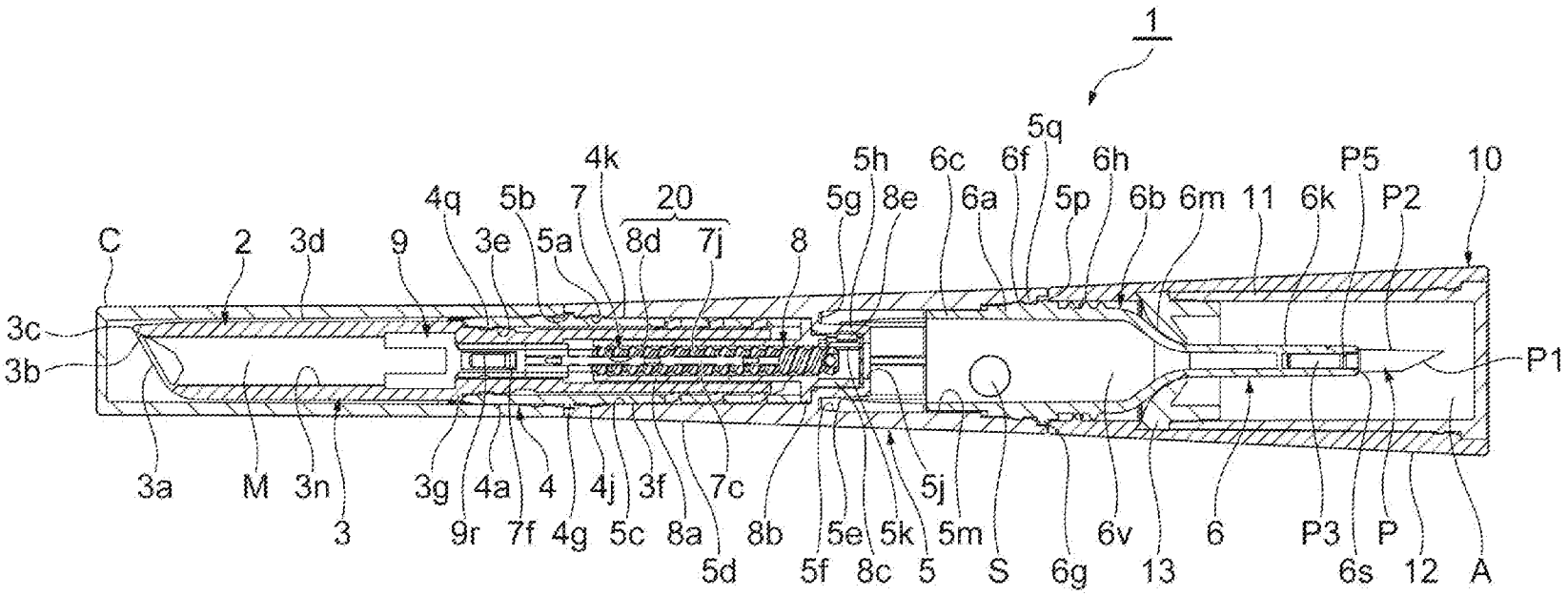
FIG. 2 is a sectional view taken along line A-A of the application container illustrated in FIG. 1.

FIGS. 1 and 2 illustrate an external view of an application container 1 according to a first group of embodiments having an overall shape which is an elongated round bar shaped like a writing tool. A cap C is attached thereto. The application container 1 includes a solid bar-shaped application material M. For example, the bar-shaped application material M is a bar-shaped cosmetic material, but may be a drawing material. In some examples, the bar-shaped application material M may be an eyebrow pencil. In the example illustrated in FIGS. 1 and 2, the application container 1 is an eyebrow feeding container.

For example, the application container 1 includes a main body 2 to which the cap C is attached, and an accommodation portion 10 which may be attached to a side opposite to the cap C of the main body 2 and accommodating the application material A. The application material A may be a powder or liquid application material. For example, the application material A may include a liquid or powder used for an eyeliner, an eye color, an eyebrow cosmetic, a mascara, a concealer, a lip color, or a hair color. Alternatively, the application material A may include a liquid or powder used for stationery goods including a writing tool, a correction fluid, or an adhesive.

In the application container 1, the cap C, the main body 2, and the accommodation portion 10 are arranged side by side along an axial direction in which an axis L of the application container 1 extends. In the description herein, an "axis" indicates a center line extending forward to and rearward from the application container 1. An "axial direction" is a forward-rearward direction, and indicates a direction along the axis L. A feeding direction of the bar-shaped application material M is defined as a forward direction (forward moving direction), and a direction opposite thereto is defined as a rearward direction.

Figure 3:
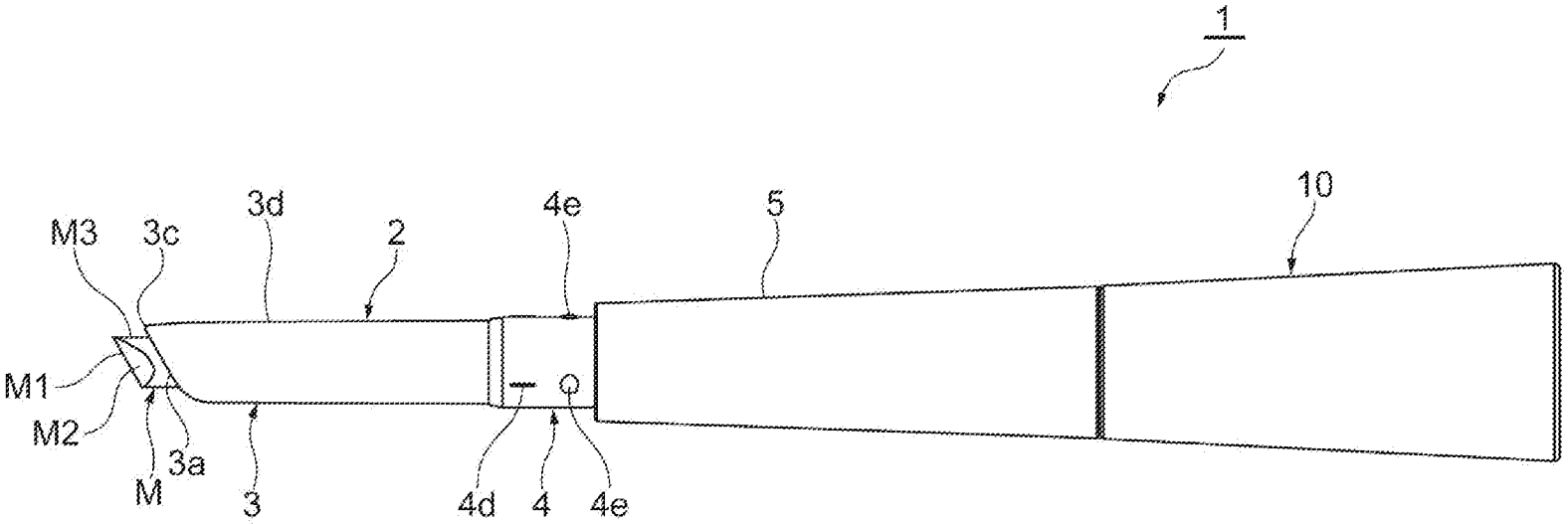
FIG. 3 is a side view illustrating a state where an example cap is removed from the application container illustrated in FIG. 1.
Figure 4:
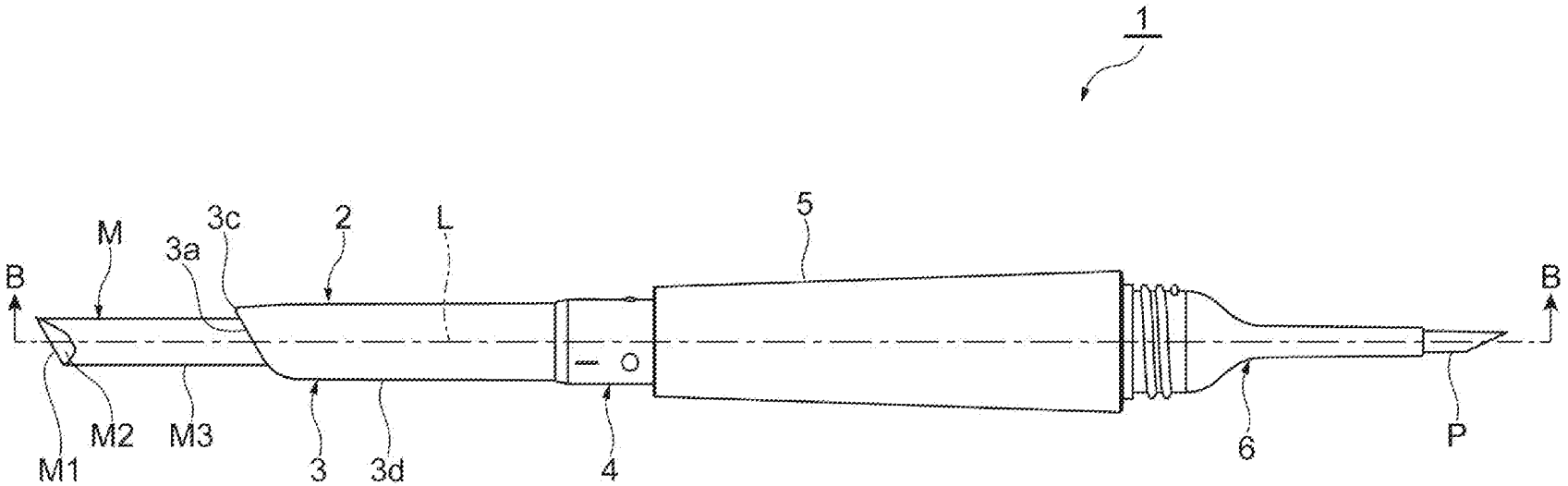
FIG. 4 is a side view illustrating a state where an example bar-shaped application material is fed from the application container illustrated in FIG. 3.
Figure 5:
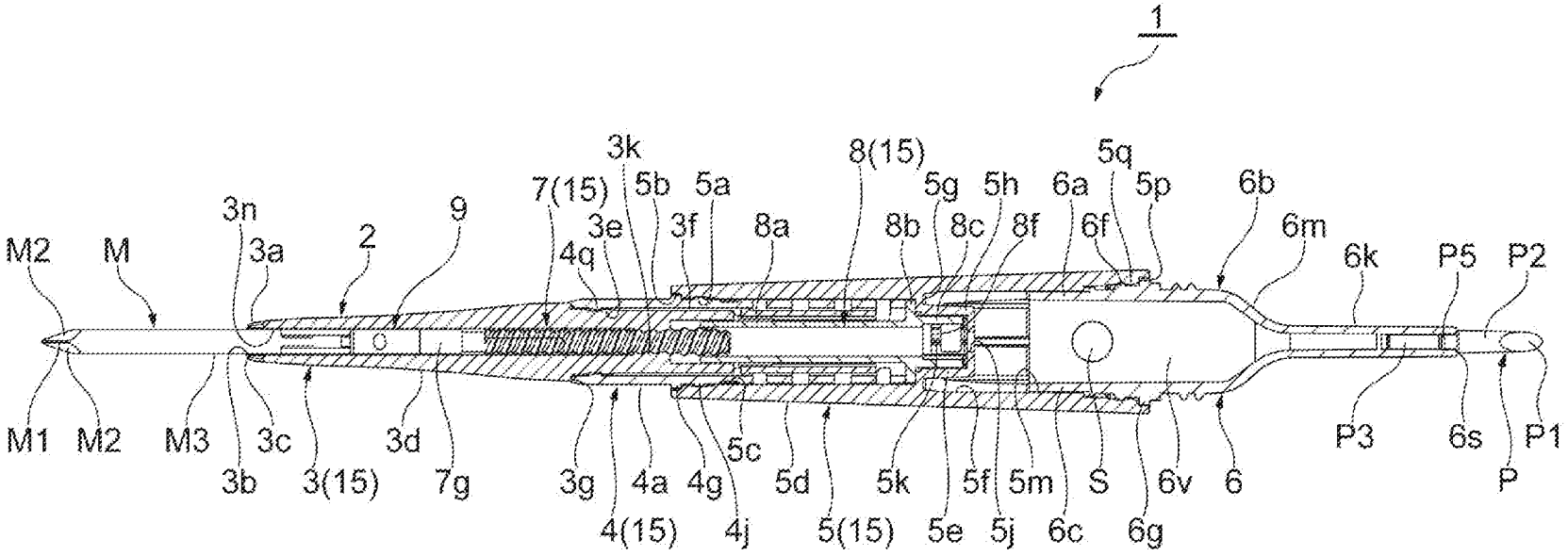
FIG. 5 is a sectional view taken along line B-B of the application container illustrated in FIG. 4.

FIG. 3 is a side view illustrating the application container 1 from which the cap C is removed. FIG. 4 is a side view illustrating a state where the bar-shaped application material M is fed by removing the accommodation portion 10 from the application container 1 illustrated in FIG. 3. FIG. 5 is a sectional view taken along line B-B in FIG. 4. As illustrated in FIGS. 3 to 5, the main body 2 includes a leading cylinder 3 forming a front portion of a container, a middle cylinder 4 disposed behind the leading cylinder 3, and a coupling cylinder 5 forming a rear portion of the container disposed behind the middle cylinder 4 and exposed outward of the application container 1. Additionally, the main body 2 may include an attachment member 6 extending rearward from the coupling cylinder 5 and to which the application tool P is attached, a moving body 7 accommodated inside the leading cylinder 3, a holding member 8 for holding the moving body 7 inside the coupling cylinder 5, and an application material holder 9 for holding the bar-shaped application material M on a front side of the moving body 7. The leading cylinder 3, the middle cylinder 4, the coupling cylinder 5, the moving body 7, and the holding member 8 may be assembled together to form a feeding mechanism 15 which feeds the bar-shaped application material M in the axial direction.

The bar-shaped application material M has a side surface M3 extending in the axial direction, and a leading end thereof has an inclined portion M1 inclined with respect to the axial direction. A shape of the bar-shaped application material M when viewed from the front side is formed so that the inclined portion M1 extends lengthwise or linearly in a uniform direction. In addition, a flat surface M2 extending in a direction inclined with respect to the axial direction is formed between the inclined portion M1 located in the leading end of the bar-shaped application material M and the side surface M3 of the bar-shaped application material M. For example, a pair of the flat surfaces M2 is disposed on both right and left sides with respect to the inclined portion M1. For example, each of the flat surfaces M2 extends rearward from both sides of the inclined portion M1 in a longitudinal direction. When the inclined portion M1 and a pair of the flat surfaces M2 are viewed from the front side, a shape thereof extends lengthwise or linearly in a uniform direction, and forms a rounded hexagonal shape.

For example, the leading cylinder 3 is molded using an ABS resin, and appears as an elongated cylindrical shape extending in the axial direction. An interior of the leading cylinder 3 serves as an accommodation space 3*n* for accommodating the bar-shaped application material M. A front end 3*c* of the leading cylinder 3 has an inclined surface 3*a* inclined with respect to the axial direction. An opening 3*b* from which the bar-shaped application material M is exposed is formed in the front end 3*c* of the leading cylinder 3. The opening 3*b* extends obliquely rearward from the front end 3*c* of the leading cylinder 3.

The leading cylinder 3 has a front side cylindrical portion 3*d* for accommodating the bar-shaped application material M, a stepped cylindrical portion 3*e* located behind the front side cylindrical portion 3*d*, and a rear side cylindrical portion 3*f* located behind the stepped cylindrical portion 3*e*. Among the front side cylindrical portion 3*d*, the stepped cylindrical portion 3*e*, and the rear side cylindrical portion 3*f*, in some examples only the front side cylindrical portion 3*d* is exposed outward. The front side cylindrical portion 3*d* gradually decreases in diameter from a step 3*g* toward the front end 3*c*. The step 3*g* is formed between the front side cylindrical portion 3*d* and the stepped cylindrical portion 3*e*, and the front side cylindrical portion 3*d* increases in diameter from the step 3*g* with respect to the stepped cylindrical portion 3*e*. A side behind the step 3*g* of the leading cylinder 3 serves as an insertion portion to be inserted into the middle cylinder 4 from the front side. The side behind the step 3*g* is inserted into the middle cylinder 4. In this manner, the leading cylinder 3 engages with the middle cylinder 4 so as to be immovable in the axial direction and relatively rotatable.

Figure 6:
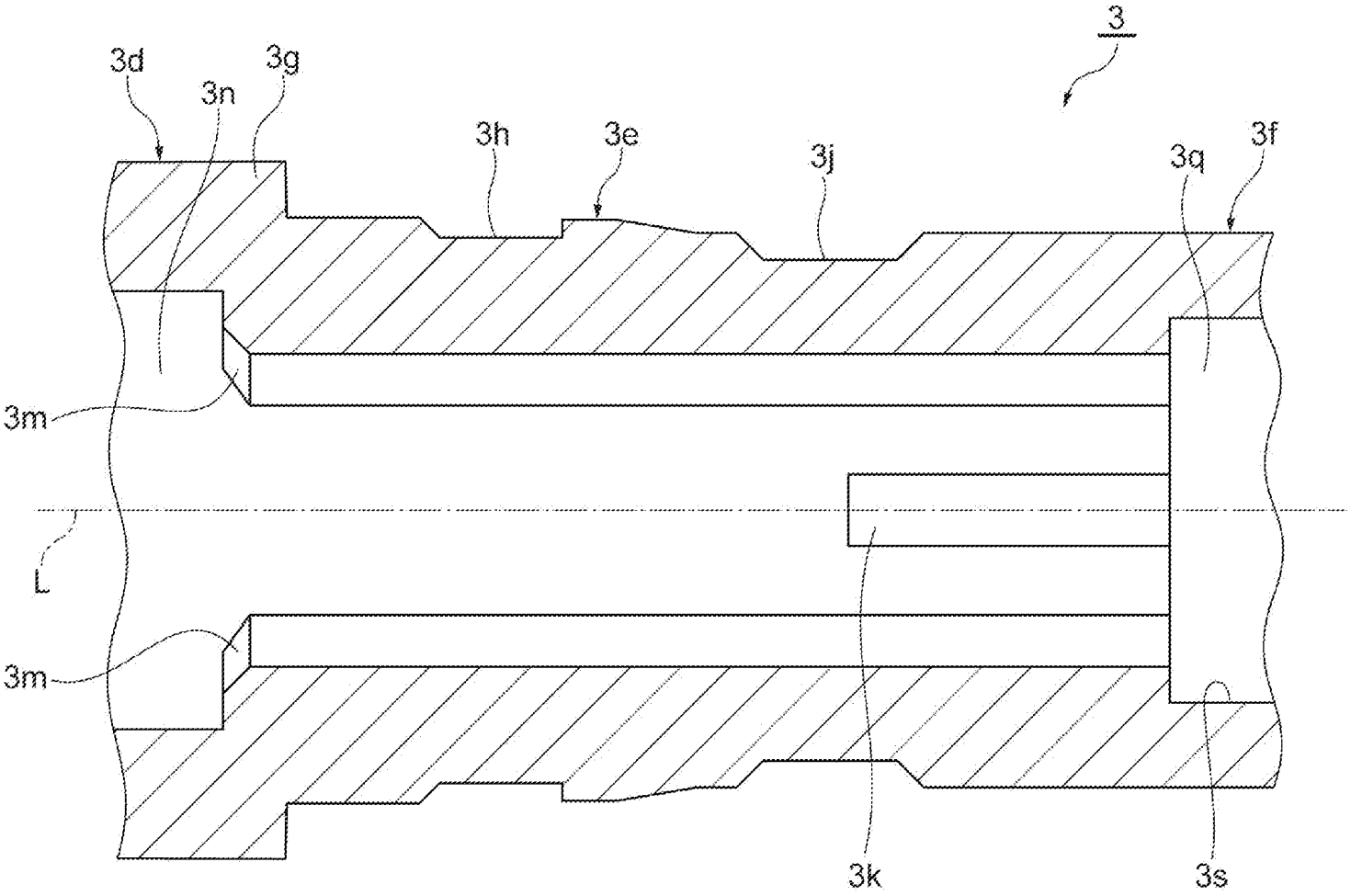
FIG. 6 is an enlarged sectional view illustrating a stepped cylindrical portion of an example leading cylinder in the application container illustrated in FIG. 5.
Figure 7A:
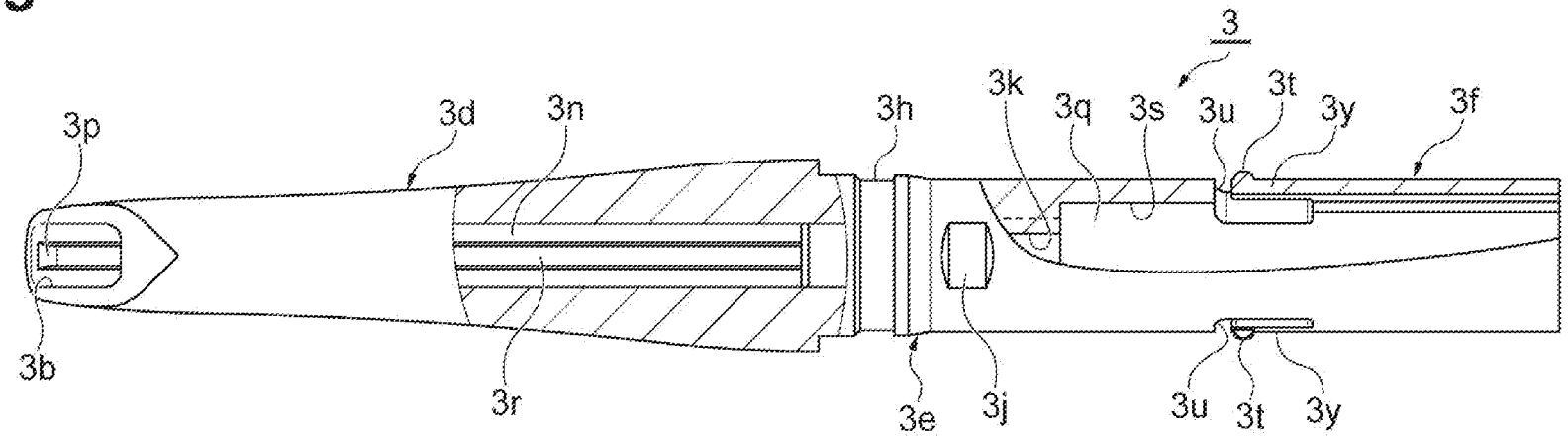
FIG. 7A is a partial sectional view illustrating the leading cylinder of the application container illustrated in FIG. 5.
Figure 7B:
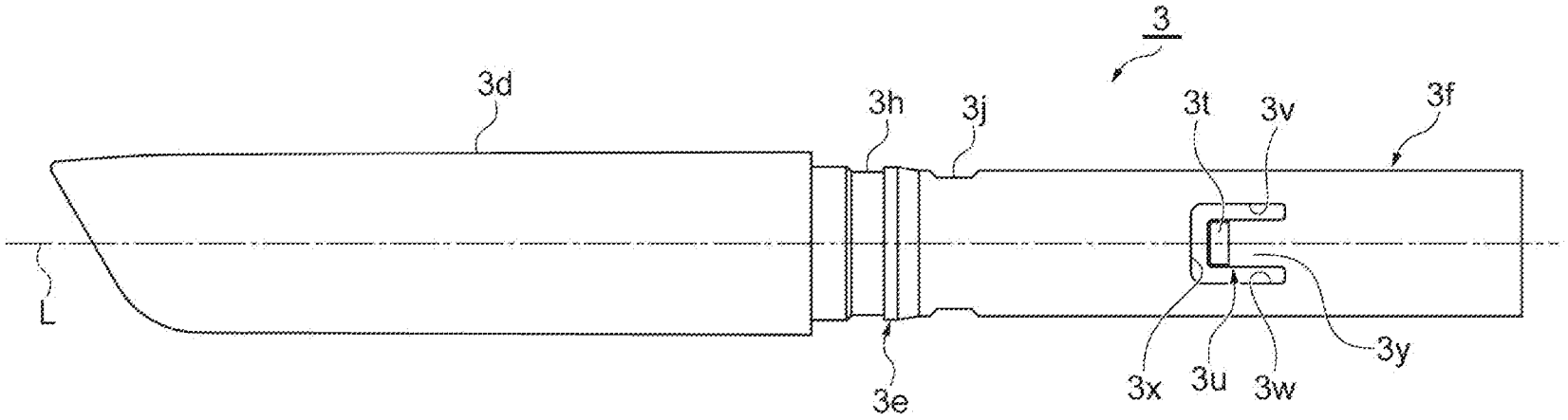
FIG. 7B is a side view illustrating the leading cylinder of the application container illustrated in FIG. 5.

FIG. 6 is a sectional view in which the stepped cylindrical portion 3*e* of the leading cylinder 3 is cut along a plane including the axial direction. FIG. 7A is a partial sectional view of the leading cylinder 3. FIG. 7B is a side view of the leading cylinder 3. As illustrated in FIGS. 6, 7A, and 7B, inside the front side cylindrical portion 3*d* of the leading cylinder 3, the accommodation space 3*n* for accommodating the bar-shaped application material M extends along the axial direction. A shape of the accommodation space 3*n* when viewed along the axial direction is a non-circular shape. For example, the shape extends lengthwise or linearly in a uniform direction. A projection portion 3*r* extending in the axial direction is disposed inside the front side cylindrical portion 3*d* of the leading cylinder 3. For example, a pair of the projection portions 3*r* is disposed along the radial direction of the leading cylinder 3.

A front end of the projection portion 3*r* leads to the vicinity of the opening 3*b* of the leading cylinder 3, and the front end of the projection portion 3*r* has an inclined surface 3*p* which protrudes by being curved inward of the leading cylinder 3 as the inclined surface 3*p* is oriented rearward. An outer surface of the stepped cylindrical portion 3*e* of the leading cylinder 3 has an annular recess portion 3*h* extending in the circumferential direction of the leading cylinder 3, and a recess portion 3*j* located behind the annular recess portion 3*h*. When the leading cylinder 3 is manufactured by means of molding, an injection port for injecting a resin material into a molding die may be located at the center of the recess portion 3*j*. In some examples, a pair of the recess portions 3*j* is disposed along the radial direction of the leading cylinder 3, and each of the recess portions 3*j* has a rectangular shape.

A ridge 3*k* extending in the axial direction is disposed inside the stepped cylindrical portion 3*e* of the leading cylinder 3. For example, a plurality of the ridges 3*k* are disposed therein. Each of the ridges 3*k* extends from the rear side of the stepped cylindrical portion 3*e* to an inner surface of the rear side cylindrical portion 3*f*. For example, a pair of the ridges 3*k* is disposed along the radial direction of the leading cylinder 3. The rear side of the accommodation space 3*n* for accommodating the bar-shaped application material M has a tapered surface 3*m* inclined rearward as the tapered surface 3*m* is oriented inward in the radial direction.

The rear side of the ridge 3*k* serves as an internal space 3*q* of the rear side cylindrical portion 3*f*, and the internal space 3*q* has a larger diameter than a portion having the ridge 3*k*. The rear side cylindrical portion 3*f* includes an elastic protruding portion 3*t* at a pair of positions facing each other on an inner peripheral surface 3*s* thereof. The elastic protruding portion 3*t* comes into contact with the inner surface of the middle cylinder 4 by using an elastic force, and is disposed so as to protrude outward in the radial direction. A notch 3*u* allowing the inside and the outside of the leading cylinder 3 to communicate with each other is formed around the elastic protruding portion 3*t*. The elastic protruding portion 3*t* is caused to have elasticity in the radial direction by the notch 3*u*.

The notch 3*u* includes a pair of slits 3*v* and 3*w* which are arranged side by side at a plurality of positions along the circumferential direction of the leading cylinder 3 and which extend in the axial direction. Additionally, the notch 3*u* includes a slit 3*x* drilled on the front side of the elastic protruding portion 3*t* and extending in the circumferential direction of the leading cylinder 3 between the slits 3*v* and 3*w*. A portion surrounded by the notch 3*u* in the rear side cylindrical portion 3*f* forms an arm 3*y* which is flexible in the radial direction. Accordingly, the elastic protruding portion 3*t* located on the outer surface of the leading end portion of the arm 3*y* has an elastic force (biasing force) acting in the radial direction.

Figure 8A:
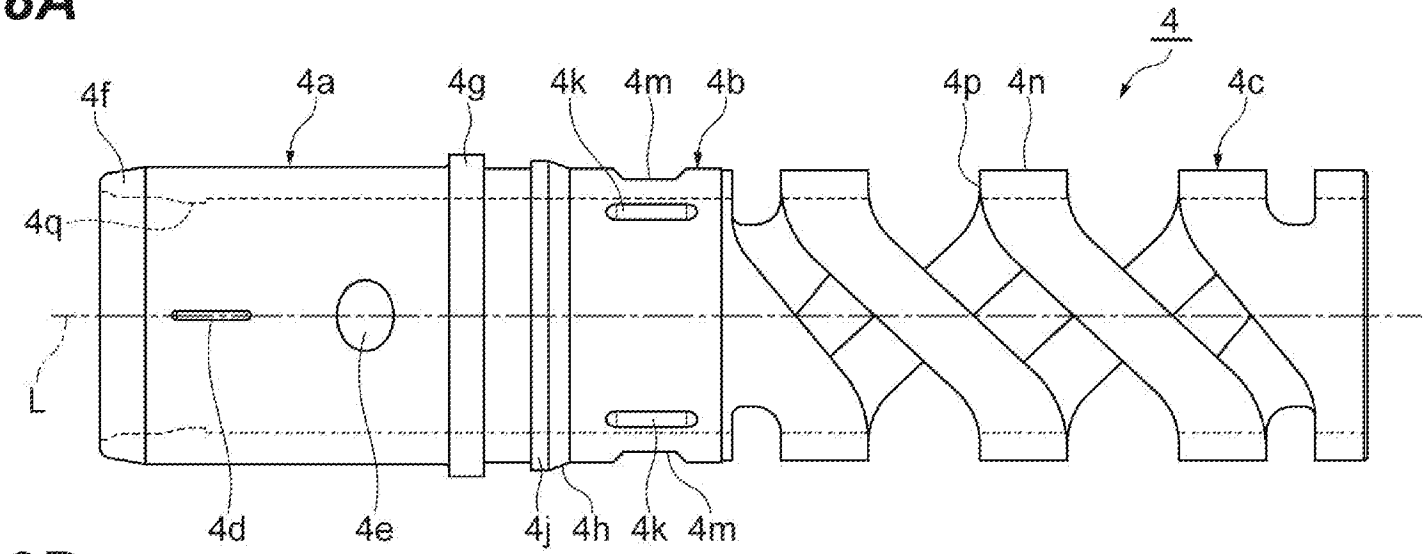
FIG. 8A is a side view illustrating an example middle cylinder of the application container illustrated in FIG. 4.
Figure 8B:
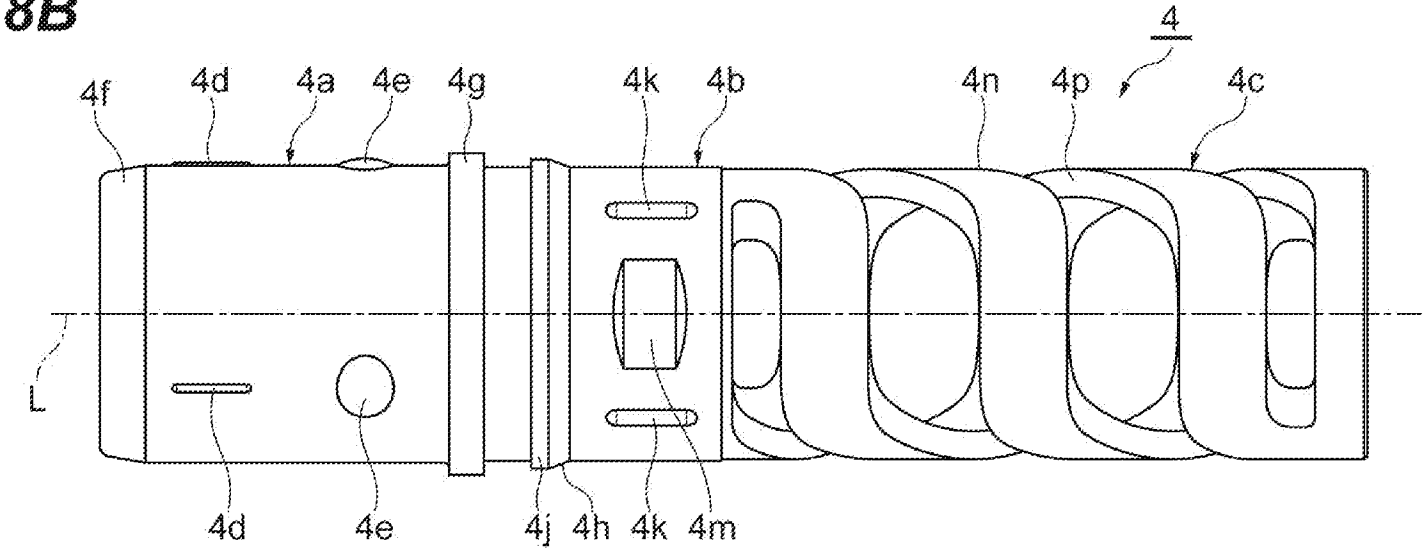
FIG. 8B is a side view when the middle container of the application container illustrated in FIG. 4 is viewed in a different rotational position from that of FIG. 8A.

The annular projection 4*q* on the inner surface of the middle cylinder 4 may be configured to engage with the stepped cylindrical portion 3*e* of the leading cylinder 3 in the axial direction so that the stepped cylindrical portion 3*e* and the annular projection 4*q* are relatively rotatable, and the elastic protruding portion 3*t* comes into contact with the inner surface of the middle cylinder 4. FIG. 8A is a side view illustrating the middle cylinder 4, and FIG. 8B is a side view when the middle cylinder 4 is viewed in a rotational position different from that in FIG. 8A. In some examples, the middle cylinder 4 is molded using polyacetal (POM), and is formed into a substantially cylindrical shape.

As illustrated in FIGS. 8A and 8B, the middle cylinder 4 includes a front side cylindrical portion 4*a*, a rear side cylindrical portion 4*b*, and a spring portion 4*c* in this order from the front end toward the rear end. The middle cylinder 4 softens an impact internally transmitted when an external force is applied such as during falling, thereby protecting the application container 1 or the bar-shaped application material M. The spring portion 4*c* of the middle cylinder 4 has a function to screw back the screw portion 20 when a clutch is rotated up to the rearward movement limit of the bar-shaped application material M. The front end portion on the outer peripheral surface of the front side cylindrical portion 4*a* has an inclined surface 4*f* which gradually increases in diameter as the inclined surface 4*f* is oriented rearward. The outer peripheral surface of the front side cylindrical portion 4*a* has a protruding portion 4*d* extending in the axial direction, and a projection 4*e* protruding in a substantially circular shape behind the protruding portion 4*d*. The cap C engages with the protruding portion 4*d* and the projection 4*e*.

A flange portion 4*g* protruding outward in the radial direction and entering the front end of the coupling cylinder 5 is disposed between the front side cylindrical portion 4*a* and the rear side cylindrical portion 4*b*. The outer surface of the rear side cylindrical portion 4*b* has an annular projection 4*j* having an inclined surface 4*h* which decreases in diameter in the rearward direction, a plurality of protruding portions 4*k* extending in the axial direction behind the annular projection 4*j* and that are arranged side by side along the circumferential direction of the middle cylinder 4, and a recess portion 4*m* recessed between a plurality of the protruding portions 4*k*. When the middle cylinder 4 is manufactured by means of molding, an injection port for injecting a resin material such into a molding die may be located at the center of the recess portion 4*m*. The spring portion 4*c* is disposed behind the protruding portion 4*k* and the recess portion 4*m*. The spring portion 4*c* is a resin spring which is stretchable in the axial direction. The spring portion 4*c* is formed to have a main body portion 4*n* and a slit 4*p* which spirally extends along a peripheral surface of the main body portion 4*n* and which allows the inside and the outside of the main body portion 4*n* to communicate with each other. The spring portion 4*c* softens an impact by compressing when an external force is applied thereto.

As illustrated in FIGS. 2 and 5, in the middle cylinder 4, a portion on the rear side of the front side cylindrical portion 4*a* is inserted into the front side of the coupling cylinder 5. In addition, in the middle cylinder 4, the annular projection 4*j* engages with the annular recess portion 5*a* disposed on the inner surface of the coupling cylinder 5 in the axial direction, and the flange portion 4*g* fits into the recess portion 5*b* in the front end of the coupling cylinder 5. A knurling tool 5*c* for engaging with the middle cylinder 4 in the rotation direction is disposed on the rear side of the annular recess portion 5*a* of the coupling cylinder 5. The knurling tool 5*c* is formed in a shape where a plurality of irregularities are arranged side by side along the circumferential direction and the respective irregularities extend in the axial direction. The protruding portion 4*k* of the middle cylinder 4 engages with the knurling tool 5*c* in the rotation direction. In this manner, the middle cylinder 4 engages with the coupling cylinder 5 so as to be synchronously rotatable.

For example, the coupling cylinder 5 is molded using an ABS resin, and is formed in a cylindrical shape. The outer surface of the coupling cylinder 5 serves as a smooth surface having no irregularities. In some examples, the outer surface is an inclined surface 5*d* which gradually increases in diameter in a rearward direction. The holding member 8 and the middle cylinder 4 are accommodated on the front side of the coupling cylinder 5, and the attachment member 6 is accommodated on the rear side of the coupling cylinder 5. The coupling cylinder 5 includes a partition wall 5*e* which partitions the interior of the coupling cylinder 5 in the vicinity of the center in the axial direction. The holding member 8 and the middle cylinder 4 are inserted forward of the partition wall 5*e*, and the attachment member 6 is inserted rearward of the partition wall 5*e*.

The partition wall 5*e* has a protruding portion 5*g* protruding inward in the radial direction of the coupling cylinder 5 from the inner surface 5*f* of the coupling cylinder 5, a recess portion 5*h* recessed rearward from an end portion inside the protruding portion 5*g* in the radial direction, and a through-hole 5*j* penetrating in the axial direction on a bottom surface of the recess portion 5*h*. The inner surface of the recess portion 5*h* has a knurling tool 5*k* in which a plurality of irregularities are arranged side by side along the circumferential direction and the respective irregularities extend in the axial direction. The inner surface 5*f* on the rear side of the partition wall 5*e* has a larger diameter than the inner surface 5*f* on the front side of the partition wall 5*e*.

For example, the holding member 8 is molded using a POM, and is formed into a substantially cylindrical shape. The holding member 8 has a front side cylindrical portion 8*a* extending in the axial direction, a flange portion 8*b* which increases in diameter in the rear end of the front side cylindrical portion 8*a*, and a rear side cylindrical portion 8*c* engaging with the knurling tool 5*k* of the recess portion 5*h* of the coupling cylinder 5, which is a rear side portion of the flange portion 8*b*. The inner surface of the front end portion of the front side cylindrical portion 8*a* has a spiral projection 8*d* forming one side of the screw portion 20 (described in further detail later).

The flange portion 8*b* of the holding member 8 is interposed between the protruding portion 5*g* of the partition wall 5*e* of the coupling cylinder 5 and the rear end of the middle cylinder 4. The rear side cylindrical portion 8*c* of the holding member 8 includes an elastic protruding portion 8*e*. The elastic protruding portion 8*e* engages with the knurling tool 5*k* of the coupling cylinder 5 in the rotation direction, and is disposed so as to protrude outward in the radial direction. A notch 8*f* which allows the inside and the outside of the holding member 8 to communicate with each other is formed around the elastic protruding portion 8*e*. The notch 8*f* causes the elastic protruding portion 8*e* to be elastic in the radial direction. For example, a configuration of the notch 8*f* may be similar to a configuration of the notch 3*u* of the leading cylinder 3.

In some example holding members 8, the rear side cylindrical portion 8*c* is inserted into the recess portion 5*h* of the partition wall 5*e* from the front side, and the elastic protruding portion 8*e* engages with the knurling tool 5*k* of the recess portion 5*h* in the rotation direction. The elastic protruding portion 8*e* and the knurling tool 5*k* enable the holding member 8 to be synchronously rotatable around the axis with respect to the coupling cylinder 5, and can release the synchronous rotation when a prescribed or greater rotational force (torque) is applied thereto. Since the synchronous rotation is released, the bar-shaped application material M reaches a forward movement limit, and a screwing operation of the screw portion 20 is stopped. Thereafter, the leading cylinder 3 or the middle cylinder 4 may be prevented from being disassembled due to a force of relatively rotating the leading cylinder 3 and the coupling cylinder 5. In addition, in the holding member 8, the flange portion 8*b* is interposed between the partition wall 5*e* and the middle cylinder 4 in the axial direction. In this manner, the holding member 8 engages with the coupling cylinder 5 so as to be linearly immovable in the axial direction and synchronously rotatable. In addition, the moving body 7 is inserted into the front side cylindrical portion 8*a* of the holding member 8.

Figure 9A:
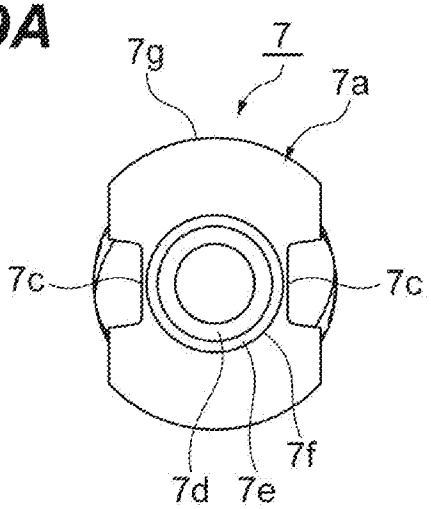
FIG. 9A is a front view when an example moving body of the application container illustrated in FIG. 5 is viewed from a front side in an axial direction.
Figure 9B:
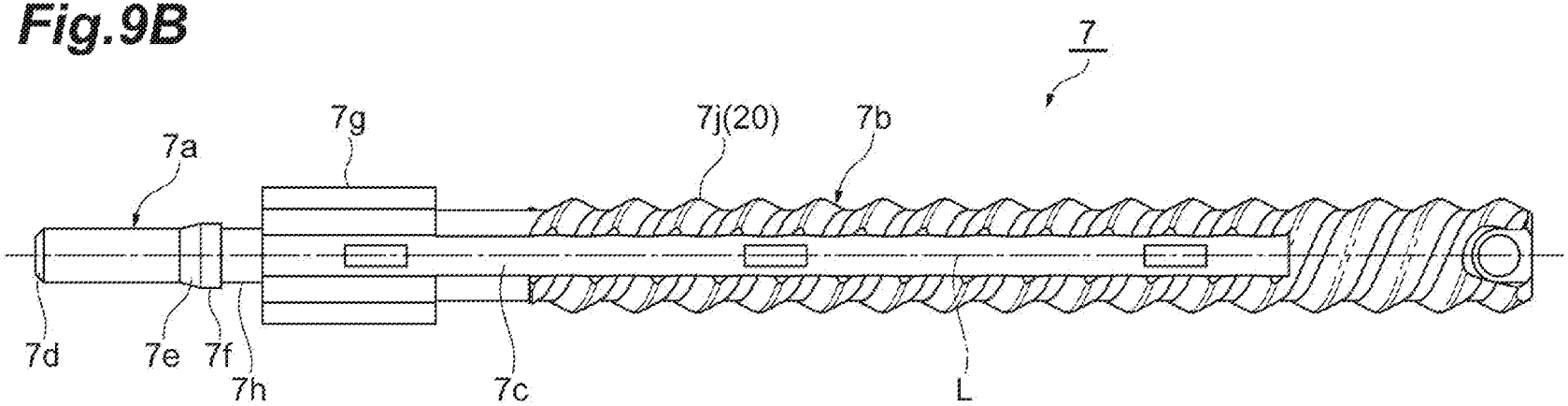
FIG. 9B is a side view illustrating the moving body of the application container illustrated in FIG. 5.

FIG. 9A is a front view when the moving body 7 is viewed from the front side, and FIG. 9B is a side view of the moving body 7. In some examples, the moving body 7 is molded using a POM, and is formed into a round bar shape. The moving body 7 includes a connector 7*a* disposed on the front side and connected to the application material holder 9, and a shaft body portion 7*b* extending rearward from the connector 7*a*. The outer surface of the connector 7*a* and the outer surface of the shaft body portion 7*b* have a groove portion 7*c* extending in the axial direction. The groove portion 7*c* functions as a detent for the moving body 7 against the leading cylinder 3, together with the ridge 3*k* disposed on the inner surface of the leading cylinder 3. For example, a pair of the groove portions 7*c* is disposed in the radial direction of the moving body 7.

The front end of the connector 7*a* of the moving body 7 has a tapered surface 7*d* which increases in diameter in the rearward direction. The connector 7*a* has an annular projection 7*f* having a tapered surface 7*e* which gradually increases in diameter in the rearward direction behind the tapered surface 7*d*, and an enlarged diameter portion 7*g* having a larger diameter than the annular projection 7*f* behind the annular projection 7*f*. A portion between the annular projection 7*f* and the enlarged diameter portion 7*g* serves as a reduced diameter portion 7*h* which has a decreased diameter relative to the annular projection 7*f* and the enlarged diameter portion 7*g*.

The shaft body portion 7*b* is a shaft body extending from the rear end of the connector 7*a* in the axial direction. The outer surface of the shaft body portion 7*b* has a male screw 7*j* forming the other one of the screw portion 20. The male screw 7*j* is formed throughout the axial direction of the shaft body portion 7*b*. In some examples, the annular projection 7*f* is inserted into the application material holder 9, and the front end of the enlarged diameter portion 7*g* comes into contact with the rear end of the application material holder 9. In this manner, the moving body 7 engages with the application material holder 9 in the axial direction. The groove portion 7*c* of the moving body 7 engages with the ridge 3*k* which is formed on the inner surface of the leading cylinder 3 in the rotation direction. The moving body 7 is inserted into the front side of the holding member 8, and the male screw 7*j* is screwed to the projection 8*d* of the holding member 8 forming one side of the screw portion 20.

Figure 10B:
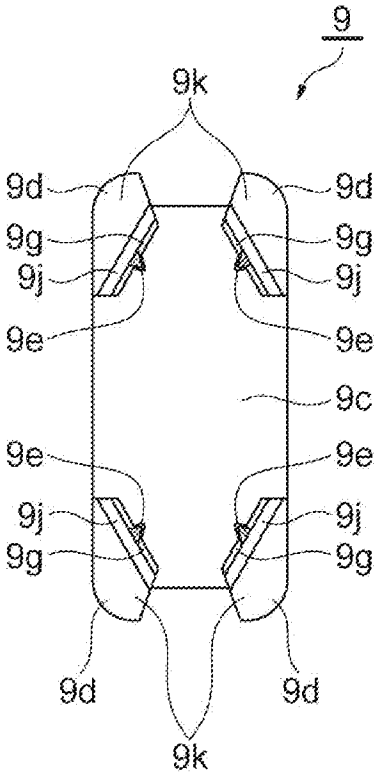
FIG. 10B is a front view when the application material holder illustrated in FIG. 10A is viewed from the front side in the axial direction.
Figure 10A:
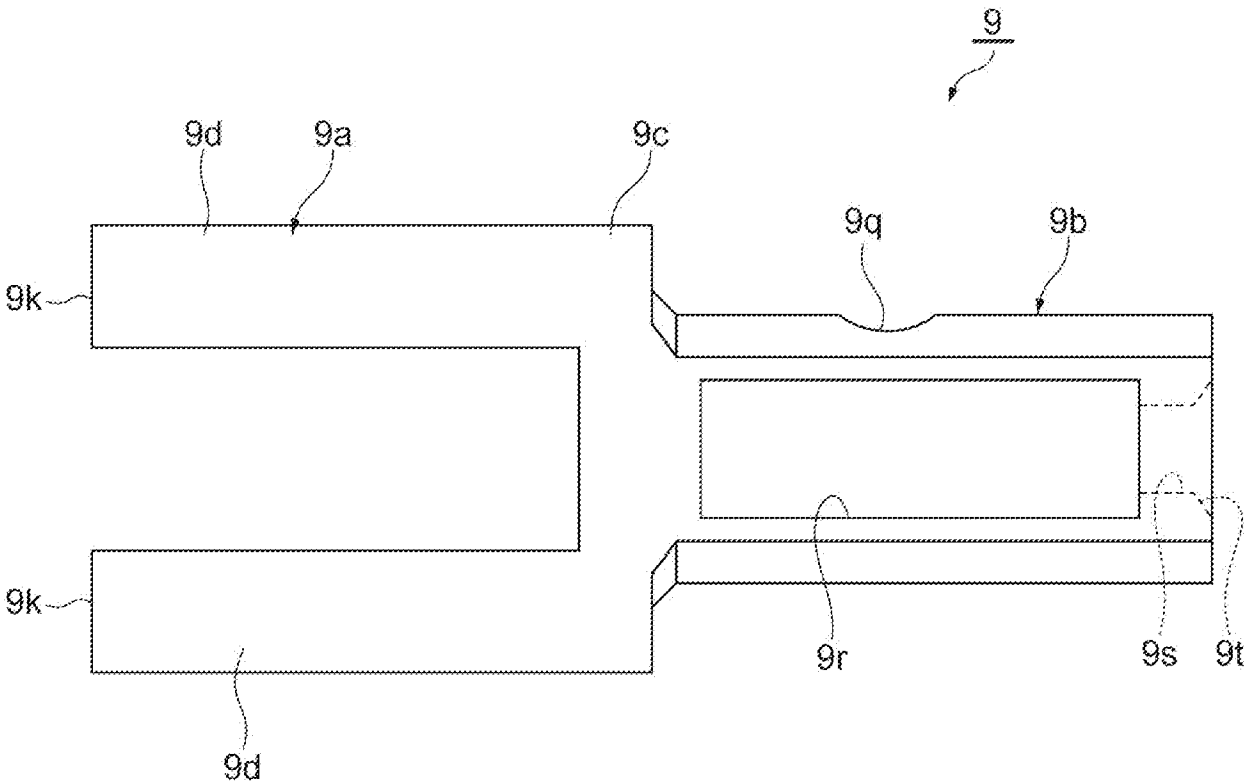
FIG. 10A is a side view illustrating an example application material holder of the application container illustrated in FIG. 2.

FIG. 10A is a side view illustrating the application material holder 9. FIG. 10B is a front view when the application material holder 9 is viewed from the front side. The application material holder 9 is a core chuck push bar internally inserted into the leading cylinder 3 so as to hold the bar-shaped application material M. For example, a material of the application material holder 9 is polybutylene terephthalate (PBT). As illustrated in FIGS. 10A and 10B, the application material holder 9 includes a gripper 9*a* located on the front side so as to grip the bar-shaped application material M, and a support portion 9*b* extending rearward from the gripper 9*a* and supporting the moving body 7. A shape of the application material holder 9 when viewed along the axial direction is a non-circular shape. For example, the application material holder 9 has a rectangular shape in which corner portions are rounded and which extends lengthwise in one direction.

The gripper 9*a* includes a base portion 9*c* forming a connector between the gripper 9*a* and the support portion 9*b*, and a plurality of arms 9*d* extending forward from the base portion 9*c* and gripping the bar-shaped application material M. The bar-shaped application material M is gripped inside a plurality of the arms 9*d*. The inner surface of the respective arms 9*d* has a protruding portion 9*e* extending in the axial direction along the arm 9*d*. Each protruding portion 9*e* fits into the bar-shaped application material M, thereby allowing the bar-shaped application material M to be properly held by the application material holder 9.

A shape of each protruding portion 9*e* when viewed along the axial direction is a triangular shape whose leading end is rounded. Each arm 9*d* decreases in thickness in a forward direction. In some examples, each arm 9*d* has a first inclined surface 9*g* and a second inclined surface 9*j* sequentially forward from the base portion 9*c*. One or more portions of the application material holder 9 may extend in the axial direction. For example, a portion between the base portion 9*c* and the first inclined surface 9*g* of the atm 9*d*, a portion between the first inclined surface 9*g* and the second inclined surface 9*j* of the atm 9*d*, and a portion between the second inclined surface 9*j* and the front end 9*k* of the arm 9*d* may extend in the axial direction.

The thickness of the arm 9*d* between the base portion 9*c* and the first inclined surface 9*g* is greater than the thickness of the arm 9*d* between the first inclined surface 9*g* and the second inclined surface 9*j*. The thickness of the arm 9*d* between the first inclined surface 9*g* and the second inclined surface 9*j* is greater than the thickness of the atm 9*d* between the second inclined surface 9*j* and the front end 9*k*. The height of the protruding portion 9*e* of the arm 9*d* is constant along the axial direction. Accordingly, a protruding height of the protruding portion 9*e* relative to a top surface of the first inclined surface 9*g* is lower than a protruding height of the protruding portion 9*e* relative to a top surface of the second inclined surface 9*j*.

The support portion 9*b* of the application material holder 9 extends from the base portion 9*c* to a side opposite to the gripper 9*a* (rearward), thereby forming a cylindrical shape having a closed bottom, for example. The support portion 9*b* has a recess portion 9*q* disposed on an outer surface thereof, a window portion 9*r* which allows the inside and the outside of the support portion 9*b* to communicate with each other, and a through-hole 9*s* disposed in the rear end of the application material holder 9 and penetrating the application material holder 9 in the axial direction. An injection port for injecting a resin material into a molding die when the application material holder 9 is manufactured by means of molding may be located at the center of the recess portion 9*q*. The rear end portion of the through-hole 9*s* has a tapered surface 9*t* which increases in diameter in a rearward direction. In some examples, the recess portion 9*q* has a circular shape, and the window portion 9*r* has a rectangular shape extending lengthwise in the axial direction. The window portion 9*r* and the through-hole 9*s* communicate with each other. The through-hole 9*s* when viewed from the rear has a circular shape.

In the application material holder 9, the moving body 7 is inserted into the through-hole 9*s* from behind. Additionally, the annular projection 7*f* of the moving body 7 rides over the inner surface of the through-hole 9*s* in the window portion 9*r*. The annular projection 7*f* fits into the window portion 9*r*, and is exposed outward from the window portion 9*r*. In this manner, the application material holder 9 engages with the moving body 7 so as to be immovable in the axial direction. The application material holder 9 having the non-circular shape enters the accommodation space 3*n* having the non-circular shape of the leading cylinder 3. In this manner, the application material holder 9 engages with the leading cylinder 3 in the rotation direction, and is synchronously rotated together with the leading cylinder 3.

Figure 11A:
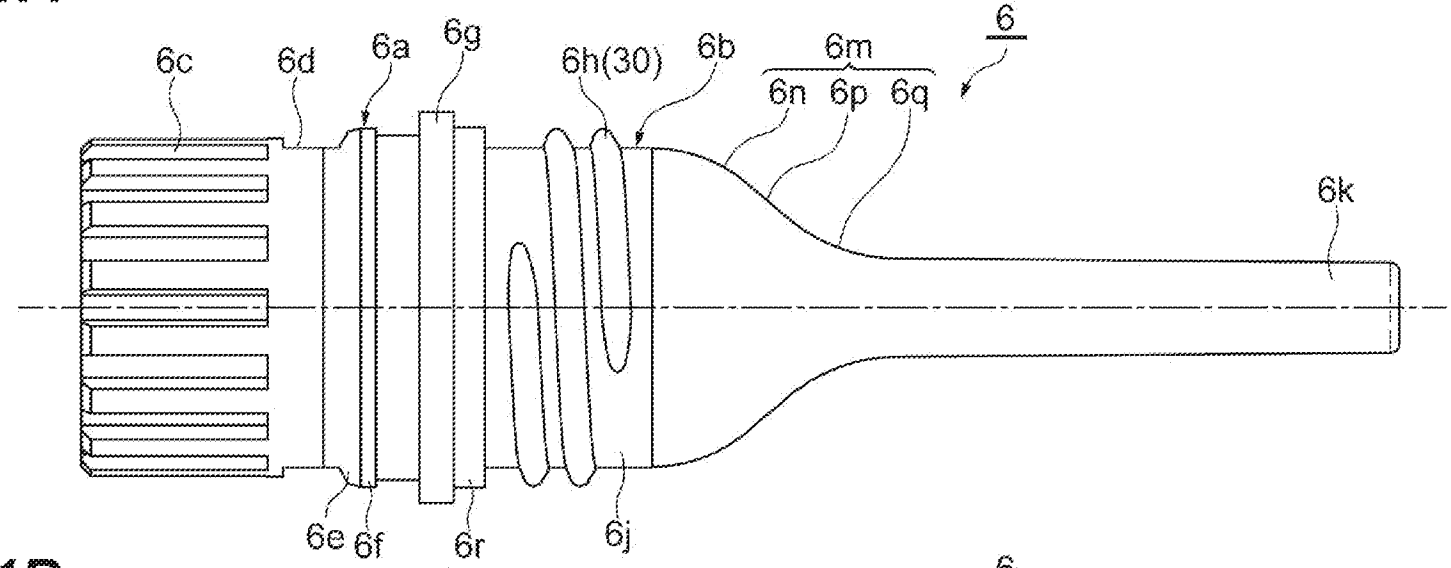
FIG. 11A is a side view illustrating an example attachment member of the application container illustrated in FIG. 4.
Figure 11B:
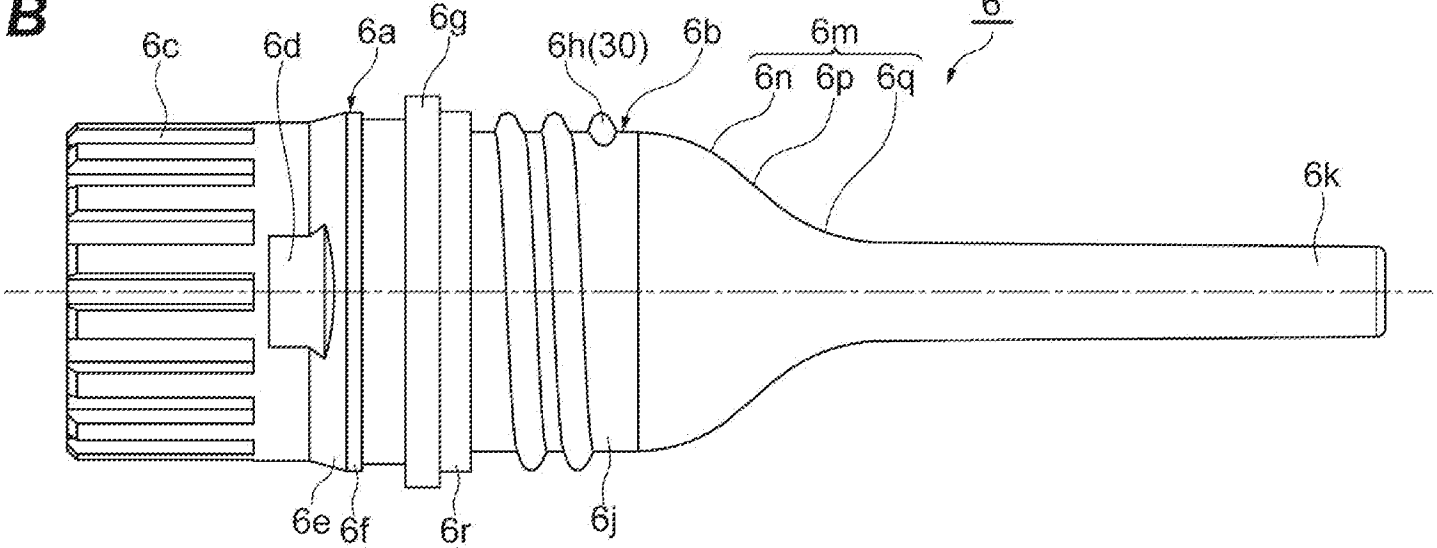
FIG. 11B is a side view when the attachment member of the application container illustrated in FIG. 4 is viewed in a direction different from that of FIG. 11A.

The attachment member 6 is inserted into the rear side of the partition wall 5*e* of the coupling cylinder 5. FIG. 11A is a side view illustrating the attachment member 6, and FIG. 11B is a side view when the attachment member 6 is viewed from a rotational position different from that in FIG. 11A. The attachment member 6 may be formed of polypropylene (PP). As illustrated in FIGS. 11A and 11B, the attachment member 6 has a cylindrical shape which gradually decreases in diameter rearward from the front side. The attachment member 6 includes an insertion portion 6*a* located on the front side and inserted into the coupling cylinder 5, and an attachment portion 6*b* extending rearward from the insertion portion 6*a* and having the application tool P attached to the leading end.

The insertion portion 6*a* has a stepped cylindrical shape. The outer surface of the insertion portion 6*a* has a knurling tool 6*c* extending in the axial direction, a recess portion 6*d* disposed on the rear side of the knurling tool 6*c*, an annular projection portion 6*f* protruding from the recess portion 6*d* and having a tapered surface 6*e* on the front side, and a flange portion 6*g* which has a greater diameter behind the annular projection portion 6*f*. The attachment portion 6*b* includes a large diameter portion 6*j* having a male screw 6*h* forming one side of a screw portion 30 for mounting the accommodation portion 10 on the main body 2, and a small diameter portion 6*k* extending rearward from the large diameter portion 6*j* and to which the application tool P is attached.

Both the large diameter portion 6*j* and the small diameter portion 6*k* have a cylindrical shape extending in the axial direction. An enlarged diameter portion 6*r* which increases in diameter from the outer surface of the attachment member 6 having the male screw 6*h* is disposed in front of the male screw 6*h* of the large diameter portion 6*j*. The enlarged diameter portion 6*r* is disposed on the rear side of the flange portion 6*g*. The height protruding outward in the radial direction of the enlarged diameter portion 6*r* is lower than the height protruding outward in the radial direction of the flange portion 6*g*. An inclined surface 6*m* which gradually decreases in diameter from the large diameter portion 6*j* toward the small diameter portion 6*k* is disposed between the large diameter portion 6*j* and the small diameter portion 6*k*.

The inclined surface 6*m* has an arc-shaped first bending portion 6*n* having a center of rotation located inside in the radial direction of the attachment member 6, an inclined portion 6*p* located on a side opposite to the large diameter portion 6*j* of the first bending portion 6*n*, and an arc-shaped second bending portion 6*q* having a center of rotation located outside in the radial direction of the attachment member 6. The first bending portion 6*n*, the inclined portion 6*p*, and the second bending portion 6*q* are disposed in this order from the large diameter portion 6*j* toward the small diameter portion 6*k*. An inclination angle of the inclined portion 6*p* with respect to the axial direction is 36°, for example.

As illustrated in FIGS. 2 and 5, the attachment member 6 internally has a space 6*v*, and the space 6*v* accommodates a stirring member S for stirring the application material A. For example, a material of the stirring member S is SUS. However, the material may be a resin, and may be appropriately changed. The stirring member S is accommodated in a portion on the front side from the inclined surface 6*m* on the inner surface of the attachment member 6. For example, the stirring member S is a ball, and is formed into a spherical shape. The stirring member S emits sound by moving inside the space 6*v* in accordance with vibrations applied to the application container 1. The small diameter portion 6*k* of the attachment portion 6*b* extends rearward from the inclined surface 6*m*. The rear end of the small diameter portion 6*k* has an opening 6*s* into which the application tool P is inserted.

In the attachment member 6, the insertion portion 6*a* is inserted into the coupling cylinder 5 from behind, and the knurling tool 6*c* engages with the ridge 5*m* on the inner surface of the coupling cylinder 5 in the rotation direction. The annular projection portion 6*f* engages with the annular projection portion 5*q* on the inner surface of the coupling cylinder 5 in the axial direction. In this manner, the attachment member 6 engages with the coupling cylinder 5 so as to be immovable in the axial direction and non-rotatable. Then, the flange portion 6*g* of the attachment member 6 enters the annular recess portion 5*p* formed in the rear end of the coupling cylinder 5.

The application tool P has a round bar shape, and has an inclined surface P1 in one end in the longitudinal direction. The inclined surface P1 is disposed in the rear end of the main body 2, and is inclined so as to form an acute angle with respect to the axial direction. For example, the inclined surface P1 has a flat shape. The application tool P has a large diameter portion P2 having the inclined surface P1 and a small diameter portion P3 extending forward from the large diameter portion P2. The small diameter portion P3 is inserted into the opening 6*s* of the attachment member 6. The outer surface of the small diameter portion P3 has an annular projection portion P5 which causes the application tool P to engage with the attachment member 6 and which has a tapered surface on the front side. In the application tool P, the small diameter portion P3 is inserted into the opening 6*s* of the attachment member 6 from the rear side, and the annular projection portion P5 rides over the annular projection portion inside the opening 6*s* so as to move forward. In this manner, the application tool P engages with the attachment member 6 in the axial direction.

Next, the accommodation portion 10 attached to the attachment member 6 and accommodating the application material A will be described in additional detail. The accommodation portion 10 includes a cylindrical filling unit 11 having a closed bottom and filled with the application material A, a cover 12 surrounding the filling unit 11 and attached to the attachment member 6, and a soft material-made wiper 13 which draws the application tool P and the small diameter portion 6*k* of the attachment member 6 so as to wipe off the application material A excessively adhering to the application tool P and the small diameter portion 6*k*.

Figure 12:
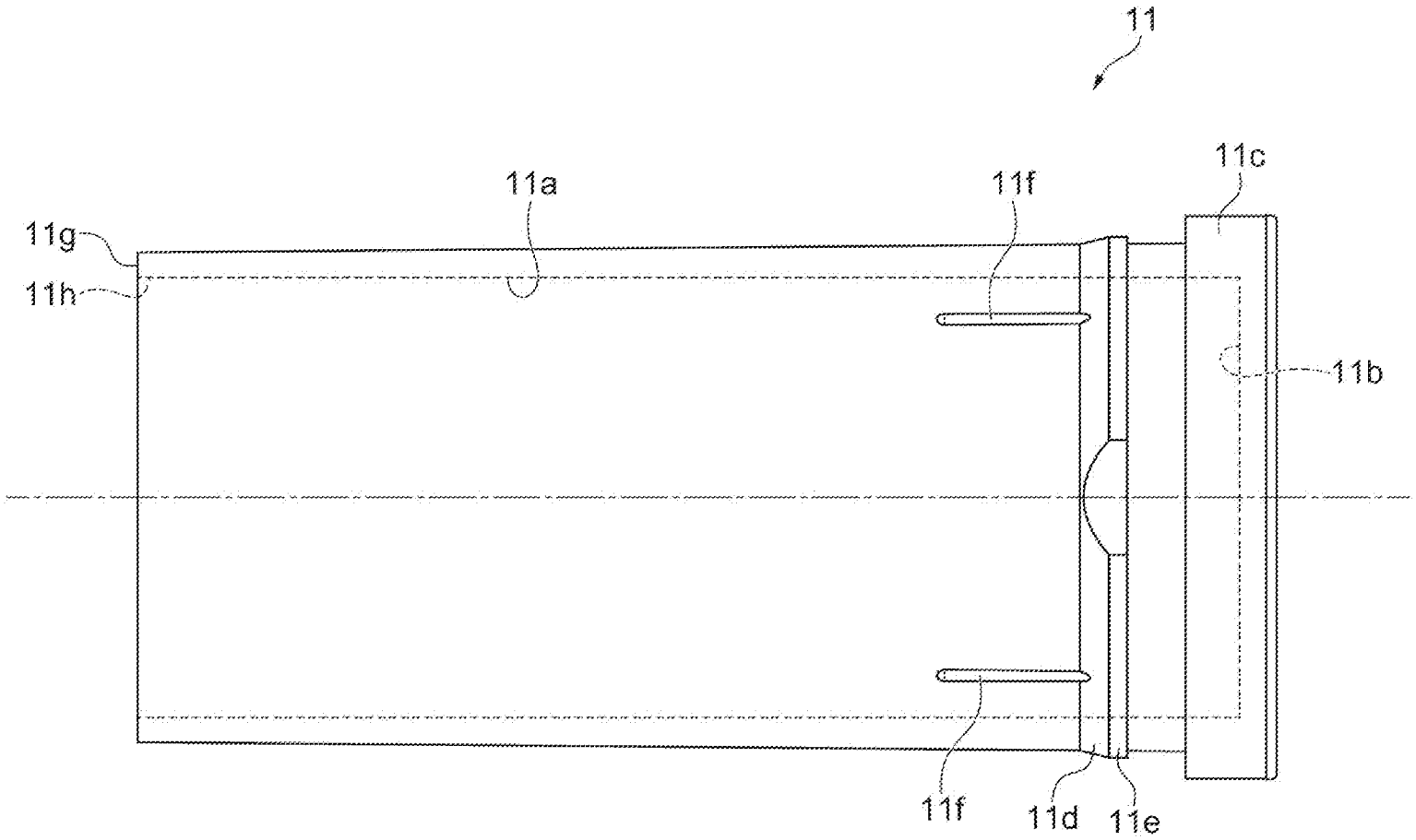
FIG. 12 is a side view illustrating an example filling unit of the application container illustrated in FIG. 2.

FIG. 12 is a side view illustrating the filling unit 11. For example, the filling unit 11 is formed of PP. As illustrated in FIG. 12, the filling unit 11 is formed in a cylindrical shape. The inner surface of the filling unit 11 has no irregularities, and serves as a smooth surface. The inner surface of the filling unit 11 is configured to include an inner surface 11*a* smoothly curved in a cylindrical hole shape, and a flat bottom surface 11*b* located in the rear end of the inner surface 11*a*.

The front side of the outer surface of the filling unit 11 has no irregularities, and serves as the smooth surface. The filling unit 11 has an opening 11*h* into which the wiper 13 is inserted in one end 11*g* on the front side. The rear side of the outer surface of the filling unit 11 includes an enlarged diameter portion 11*c* protruding outward in the radial direction in the rear end of the filling unit 11, an annular projection portion 11*e* located in front of the enlarged diameter portion 11*c* and having a tapered surface 11*d* on the front side, and a plurality of projection portions 1 if extending forward in the axial direction from the tapered surface 11*d*. The rear end of the enlarged diameter portion 11*e* is slightly rounded. In some examples, four of the projection portions 11*f* are disposed therein. The four projection portions 11*f* are disposed at an equal interval in the circumferential direction. For example, a protruding shape of the projection portion 11*f* is an arc shape.

Figure 13B:
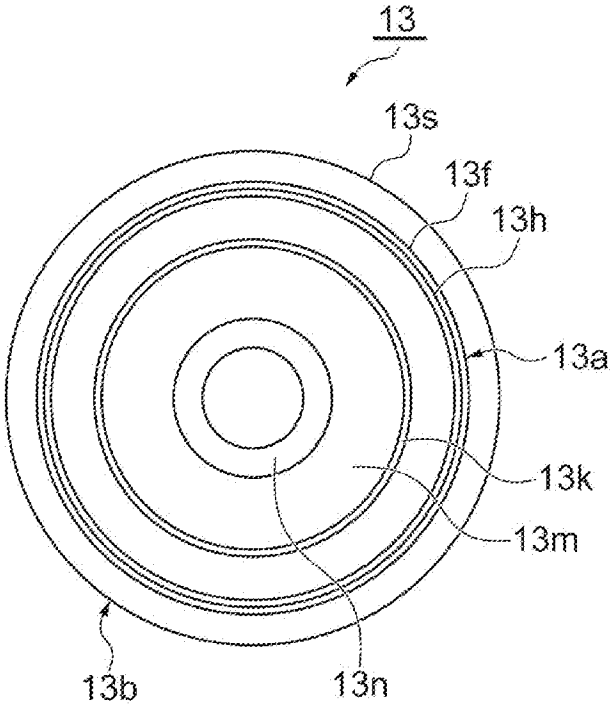
FIG. 13B is a view when the wiper of the application container illustrated in FIG. 2 is viewed from a rear side in the axial direction.
Figure 13A:
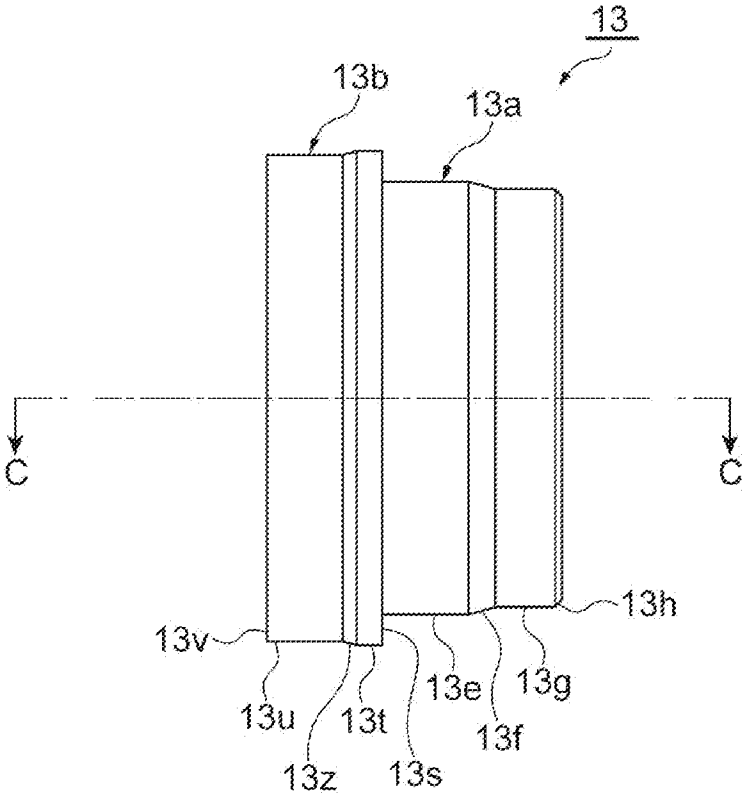
FIG. 13A is a side view illustrating an example wiper of the application container illustrated in FIG. 2.
Figure 14:
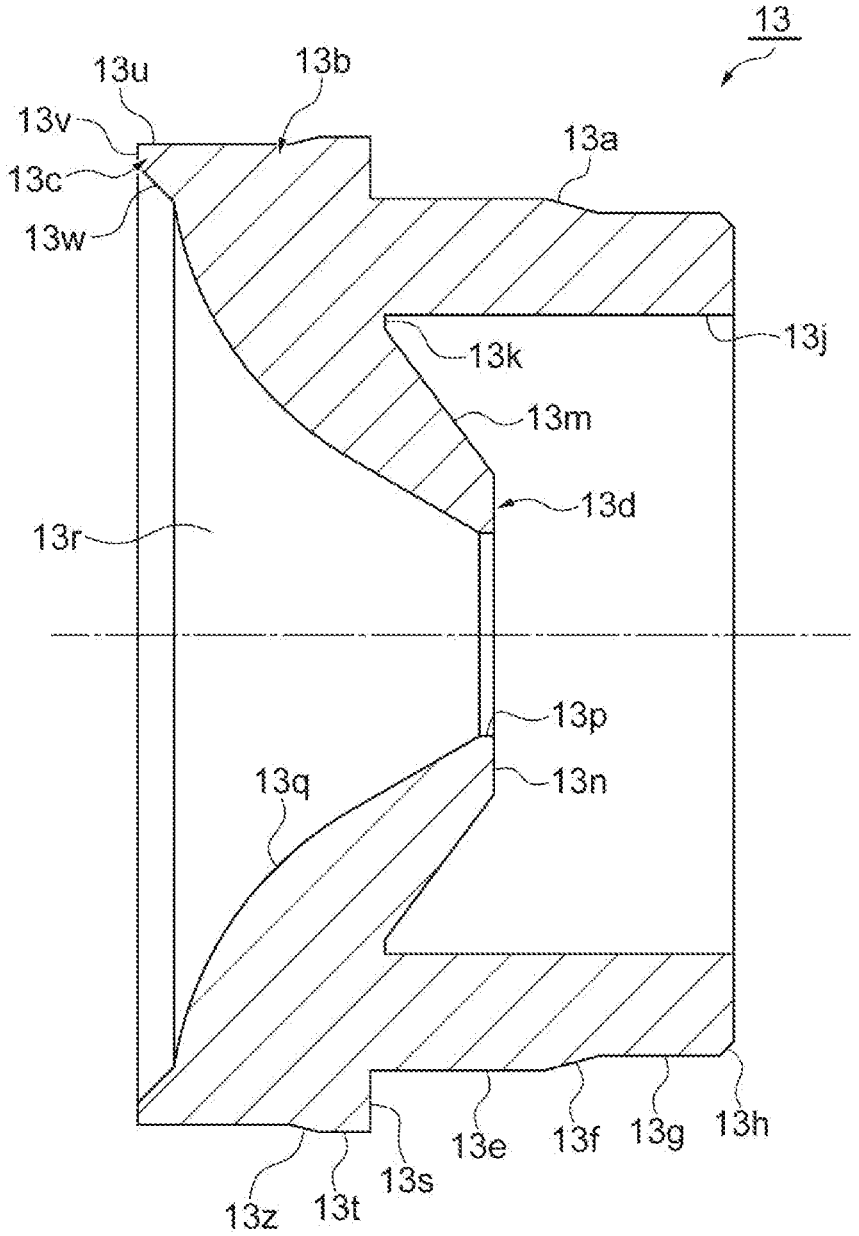
FIG. 14 is a sectional view taken along line C-C of the wiper illustrated in FIG. 13A.

FIG. 13A is a side view illustrating the wiper 13, and FIG. 13B is a view when the wiper 13 is viewed from the rear side. FIG. 14 is a sectional view taken along line C-C illustrated in FIG. 13A. The wiper 13 is formed of a rubber material. The hardness of the wiper 13 may be set to a value within the range of 40 to 80 in accordance with a type A durometer regulated in JIS 6253 (method of obtaining hardness of vulcanized rubber and thermoplastic rubber). For example, the hardness may be set to 60.

As illustrated in FIGS. 13A, 13B, and 14, the wiper 13 has a stepped cylindrical shape. The wiper 13 includes a cylindrical extension portion 13*a* extending rearward, a first protruding portion 13*b* protruding outward in the radial direction in the front end of the extension portion 13*a*, a second protruding portion 13*c* further protruding forward from the front end of the first protruding portion 13*b*, and a drawing portion 13*d* protruding inward in the radial direction from the extension portion 13*a* and the first protruding portion 13*b*.

The extension portion 13*a* has a first side surface 13*e* extending in the axial direction from the rear end of the first protruding portion 13*b*, a first tapered surface 13*f* inclined inward in the radial direction of the wiper 13 from the rear end of the first side surface 13*e*, a second side surface 13*g* extending in the axial direction from the rear end of the first tapered surface 13*f*, and a second tapered surface 13*h* inclined inward in the radial direction of the wiper 13 from the rear end of the second side surface 13*g*. The rear end of the second tapered surface 13*h* corresponds to the rear end of the wiper 13.

The wiper 13 has a through-hole 13*r* into which the application tool P and the attachment member 6 are inserted, and the through-hole 13*r* penetrates the wiper 13 in the axial direction. The inner surface of the extension portion 13*a* of the wiper 13 is configured to include an inner peripheral surface 13*j* smoothly curved in a cylindrical hole shape, and the drawing portion 13*d* protruding inward in the radial direction from the front end of the inner peripheral surface 13*j*. The drawing portion 13*d* includes a first planar portion 13*k* located in the front end of the inner peripheral surface 13*j*, a first extension portion 13*m* extending inward in the radial direction from an end portion of the first planar portion 13*k*, an annular portion 13*n* located in the rear end of the first extension portion 13*m*, an inner peripheral surface 13*p* extending forward from the annular portion 13*n*, and a bending portion 13*q* extending from the front end of the inner peripheral surface 13*p* toward the first protruding portion 13*b*.

The first planar portion 13*k* extends inward in the radial direction from the front end of the inner peripheral surface 13*j*. The first extension portion 13*m* obliquely extends rearward and inward in the radial direction from an end portion of the first planar portion 13*k*. The annular portion 13*n* is formed in a flat shape in the rear end of the first extension portion 13*m*. The inner peripheral surface 13*p* extends forward and inward in the radial direction from an end portion of the annular portion 13*n*. The bending portion 13*q* faces the first protruding portion 13*b* from the front end of the inner peripheral surface 13*p*, and is bent forward and outward in the radial direction so that the drawing portion 13*d* bulges. The application tool P and the attachment member 6 which are to be inserted into the through-hole 13*r* come into contact with the bending portion 13*q* and the inner peripheral surface 13*p*, and move rearward. The attachment member 6 and the application tool P which are drawn forward from the through-hole 13*r* are drawn while both of these mainly come into contact with the inner peripheral surface 13*p*. In this manner, both the attachment member 6 and the application tool P are drawn by the wiper 13.

The first protruding portion 13*b* has a protruding surface 13*s* extending outward in the radial direction from the front end of the extension portion 13*a*, an outer peripheral surface 13*t* extending forward from an end portion of the protruding surface 13*s* outside in the radial direction, and a tapered surface 13*z* which decreases in diameter from the front end of the outer peripheral surface 13*t*. The second protruding portion 13*c* has a protruding surface 13*u* extending forward, an annular surface 13*v* extending inward in the radial direction from the front end of the protruding surface 13*u*, and an inclined surface 13*w* extending rearward from an end portion of the annular surface 13*v* and obliquely extending inward in the radial direction.

Figure 15A:
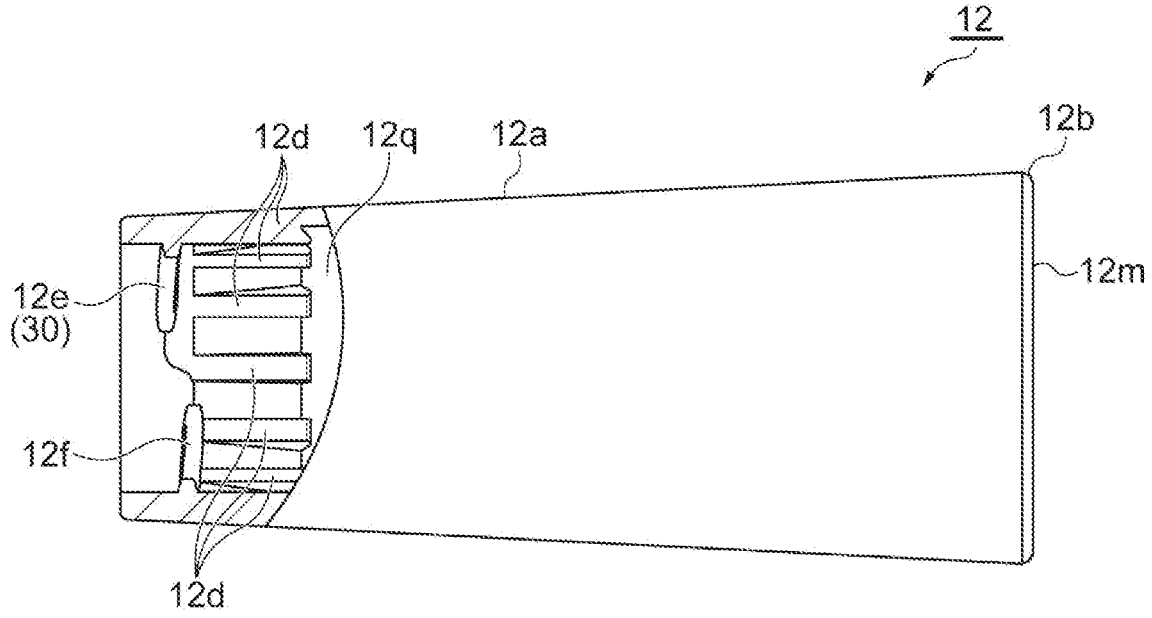
FIG. 15A is a partial sectional view illustrating an example cover of the application container illustrated in FIG. 2.
Figure 15B:
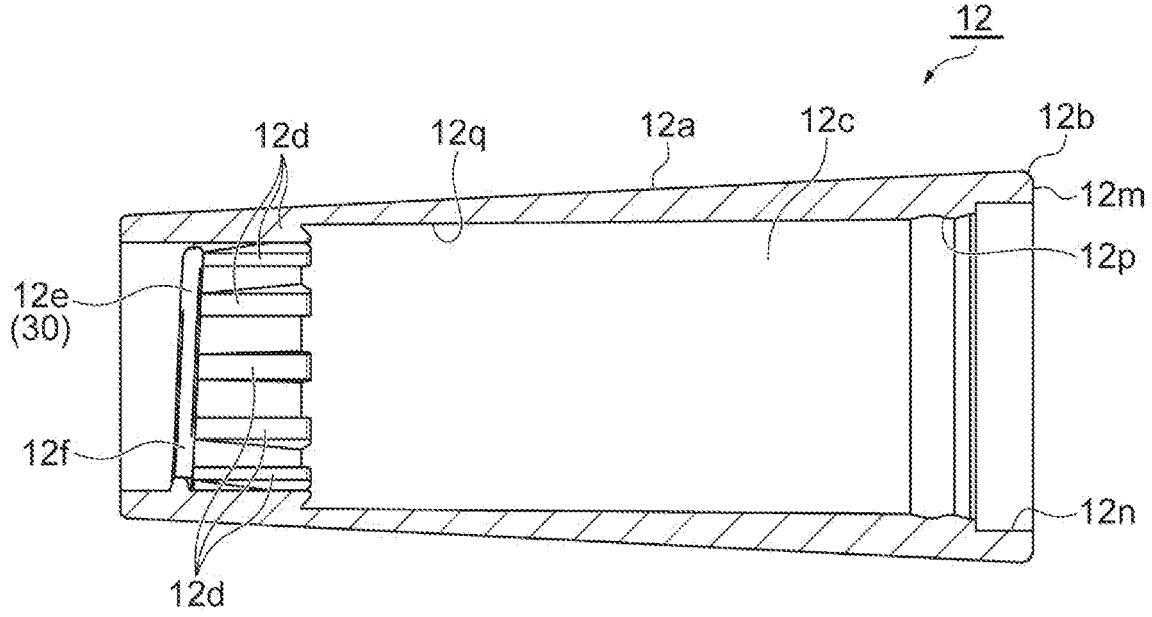
FIG. 15B is a longitudinal sectional view when the cover of the application container illustrated in FIG. 2 is cut along a plane including the axial direction.

FIG. 15A is a partial sectional view illustrating the cover 12, and FIG. 15B is a longitudinal sectional view when the cover 12 is cut along a plane including the axis L. The cover 12 has a cylindrical shape, and is formed of an ABS resin, for example. The cover 12 may have a cylindrical shape. The outer surface of the cover 12 serves as a smooth surface having no irregularities. In some examples, the outer surface is an inclined surface 12*a* which gradually increases in diameter in a rearward direction. The rear end of the inclined surface 12*a* (rear end of the cover 12) has a bending portion 12*b* which extends while being bent inward in the radial direction from the inclined surface 12*a* and which is rounded.

The rear side of the inner surface 12*q* of the cover 12 has an annular recess portion 12*n* extending forward from the rear end 12*m* of the cover 12, and an annular irregular portion 12*p* located on the front side of the annular recess portion 12*n*. The vicinity at the center of the inner surface 12*q* of the cover 12 in the axial direction serves as a smooth surface 12*c* having no irregularities. An inclination angle of the inner surface 12*q* with respect to the axial direction is smaller than an inclination angle of the inclined surface 12*a* with respect to the axial direction. Therefore, the portion of the cover 12 having the inclined surface 12*a* and the inner surface 12*q* gradually becomes thicker in the rearward direction.

The front side of the inner surface 12*q* of the cover 12 has a wall portion 12*d* protruding inward in the radial direction from the smooth surface 12*c*, and a female screw 12*e* disposed in front of the wall portion 12*d* and forms the other side of the screw portion 30. The female screw 12*e* is configured to include a spiral projection 12*f* protruding inward in the radial direction from the inner surface 12*q* of the cover 12. The cover 12 is mounted on the attachment member 6 by screwing the projection 12*f* to the male screw 6*h* forming the one side of the screw portion 30.

Figure 16:
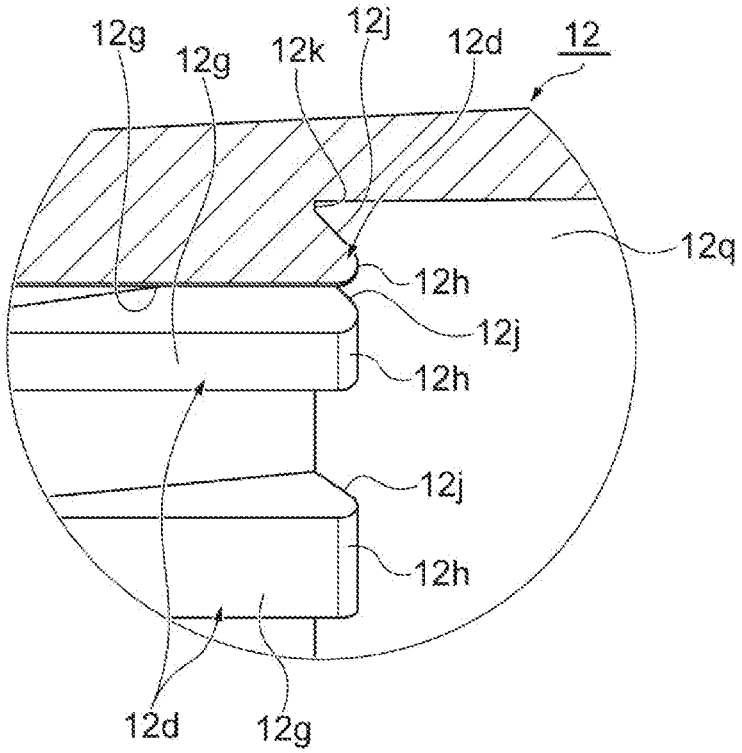
FIG. 16 is an enlarged view illustrating an example wall portion of the cover illustrated in FIGS. 15A and 15B.

FIG. 16 is an enlarged view of the wall portion 12*d* of the cover 12. As illustrated in FIGS. 15A, 15B, and 16, a plurality of the wall portions 12*d* are arranged side by side along the circumferential direction of the cover 12. In some examples, the wall portions 12*d* are intermittently formed along the circumferential direction of the cover 12. The wall portion 12*d* has a top surface 12*g* protruding inward in the radial direction as the top surface 12*g* is oriented rearward from the portion having the female screw 12*e*, a bending portion 12*h* folded outward in the radial direction and forward from the rear end of the top surface 12*g*, an inclined surface 12*j* obliquely extending outward in the radial direction and forward from the bending portion 12*h*, and a flat portion 12*k* extending further outward in the radial direction from an end portion of the inclined surface 12*j*.

In some examples, the plurality of wall portions 12*d* are arranged at an equal interval in the circumferential direction, and the number of the wall portions 12*d* is 12. The top surface 12*g* of the wall portions 12*d* extends along the axis L, and extends parallel to the axis L, for example. However, the top surface 12*g* may not extend parallel to the axis L. For example, the top surface 12*g* may be inclined in a direction away from the axis as the top surface 12*g* is oriented rearward.

Figure 17A:
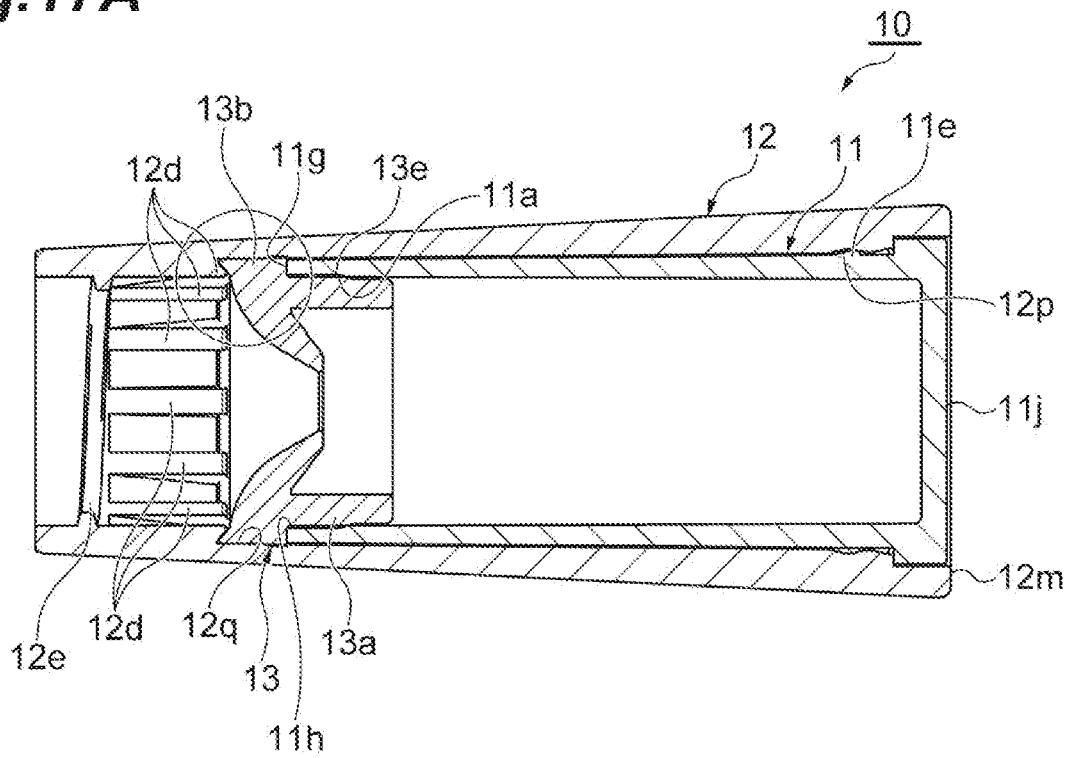
FIG. 17A is a longitudinal sectional view illustrating the filling unit, the cover, and the wiper.
Figure 17B:
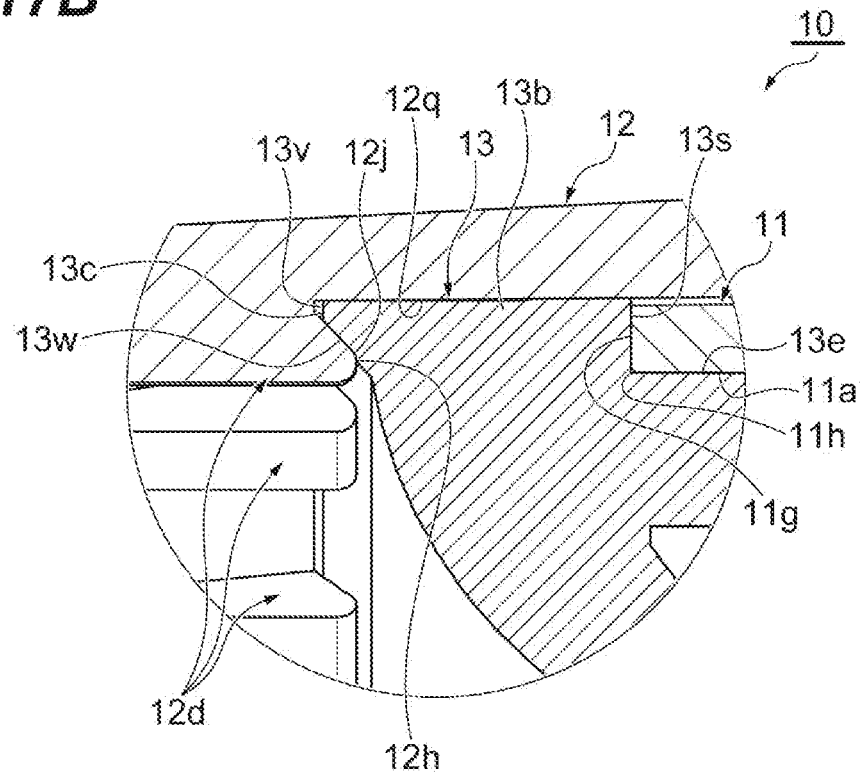
FIG. 17B is an enlarged sectional view illustrating the wiper interposed between the filling unit and the wall portion of the cover in FIG. 17A.
Figure 18A:
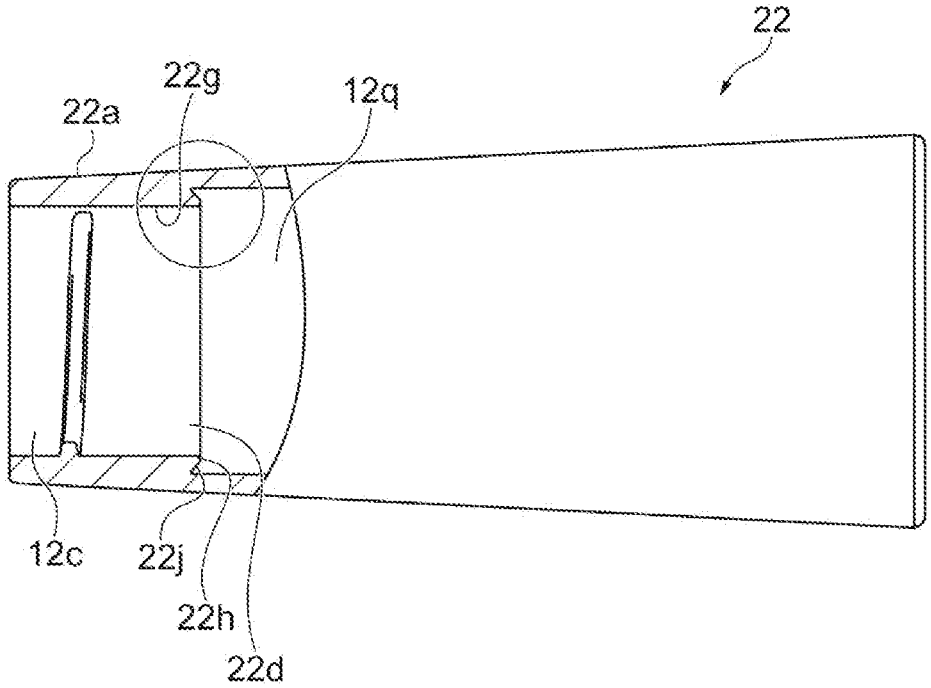
FIG. 18A is a partial sectional view illustrating a cover of an example application container according to a second group of embodiments.
Figure 18B:
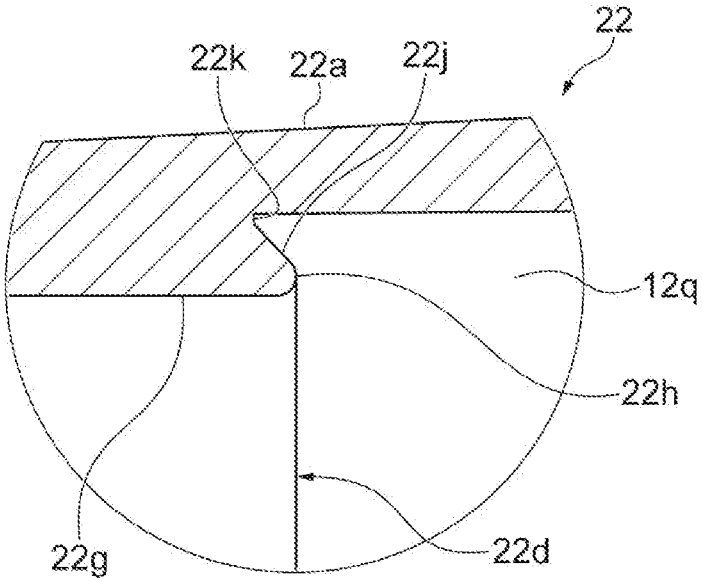
FIG. 18B is an enlarged sectional view illustrating a wall portion of the cover illustrated in FIG. 18A.
Figure 19A:
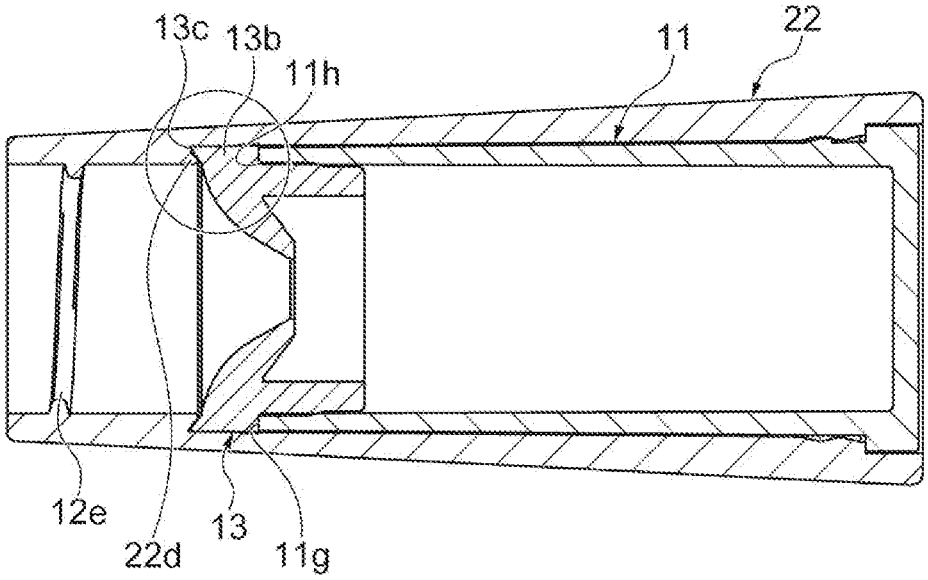
FIG. 19A is a longitudinal sectional view illustrating the cover, an example filling unit, and an example wiper illustrated in FIGS. 18A and 18B.
Figure 19B:
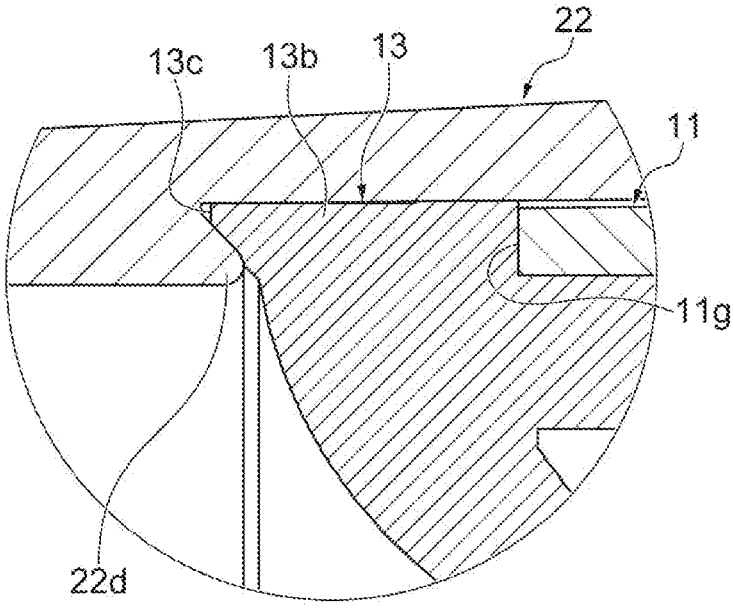
FIG. 19B is an enlarged sectional view illustrating the wiper interposed between the filling unit and the wall portion of the cover in FIG. 19A.
Figure 20A:
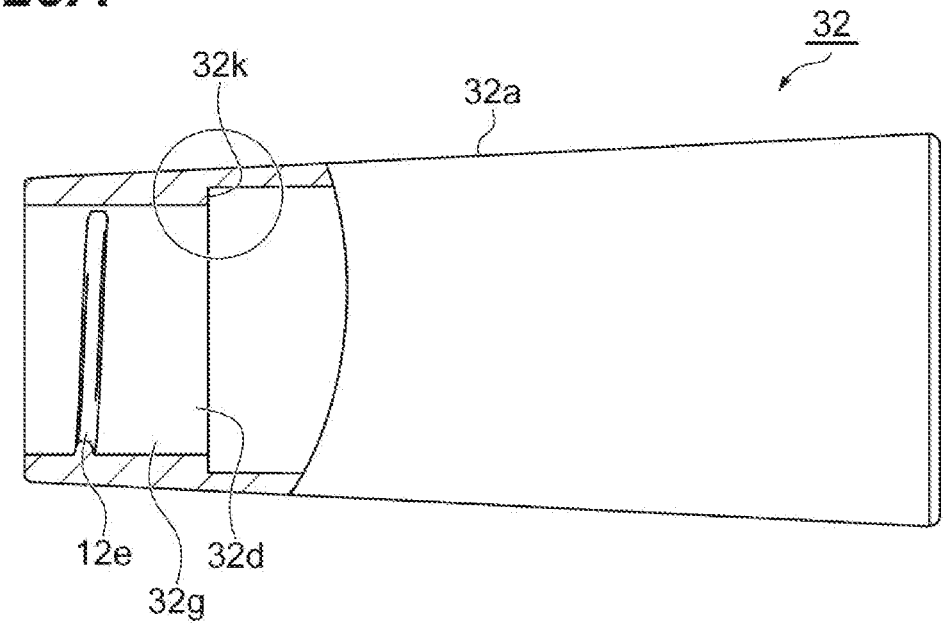
FIG. 20A is a partial sectional view illustrating a cover of an example application container according to a third group of embodiments.
Figure 20B:
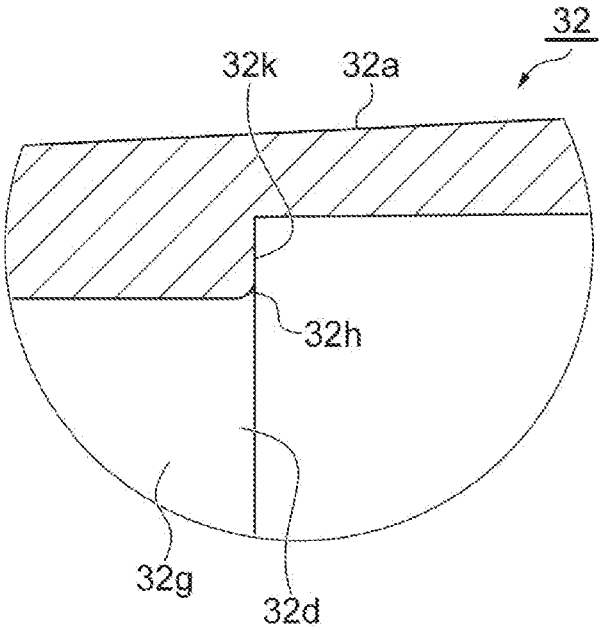
FIG. 20B is an enlarged sectional view illustrating a wall portion of the cover illustrated in FIG. 20A.
Figure 21A:
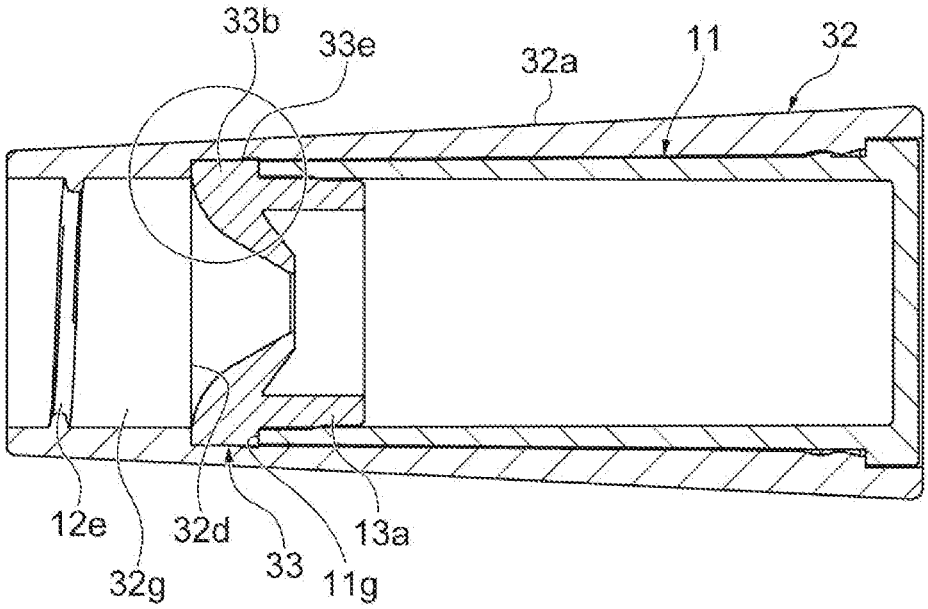
FIG. 21A is a longitudinal sectional view illustrating the cover, an example filling unit, and an example wiper which are illustrated in FIGS. 20A and 20B.
Figure 21B:
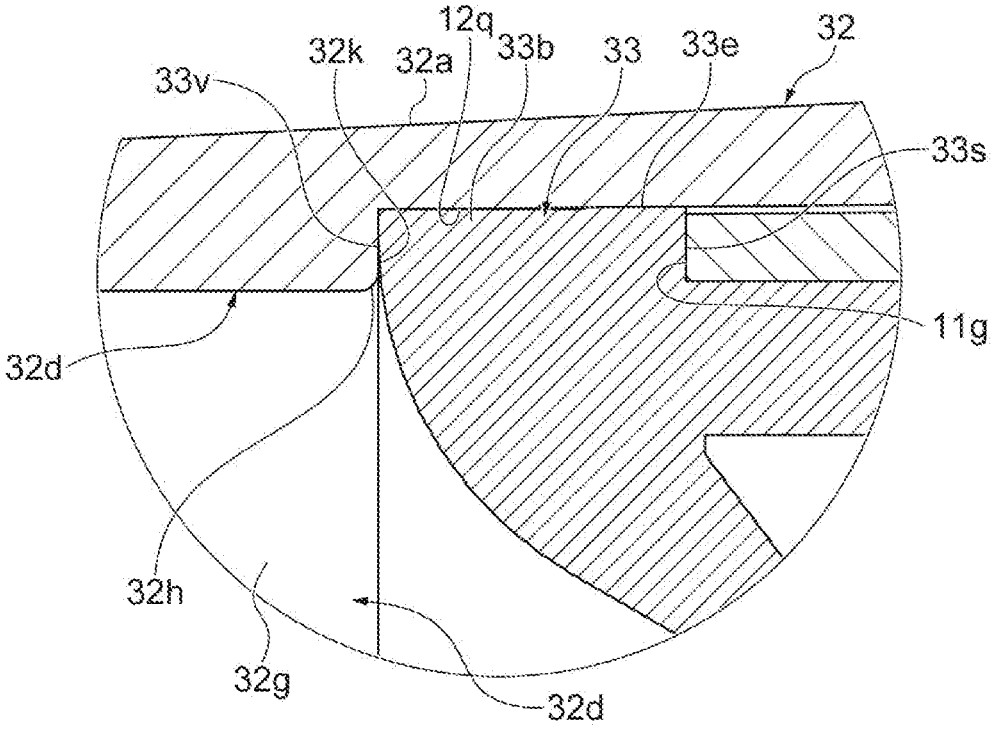
FIG. 21B is an enlarged sectional view illustrating the wiper interposed between the filling unit and the wall portion of the cover in FIG. 21A.

FIG. 17A is a longitudinal sectional view when the accommodation portion 10 including the filling unit 11, the cover 12, and the wiper 13 are cut along a plane including the axis L. FIG. 17B is an enlarged sectional view illustrating the wall portion 12*d*, the first protruding portion 13*b*, and one end 11*g* of the filling unit 11 in FIG. 17A. In the wiper 13, the extension portion 13*a* is inserted into the opening 11*h* of the filling unit 11 from the front side. The whole first side surface 13*e* closely adheres to the inner surface 11*a* of the filling unit 11, and the protruding surface 13*s* of the first protruding portion 13*b* comes into contact with one end 11*g*.

The filling unit 11 having the wiper 13 mounted thereon may be inserted into the cover 12 from the rear side. The wiper 13 and the filling unit 11 which are inserted into the cover 12 are engaged with the cover 12 in the axial direction in a state where the second protruding portion 13*c* of the wiper 13 is in contact with the wall portion 12*d* of the cover 12 in the axial direction. In some examples, the filling unit 11 and the wiper 13 engage with the cover 12 in the axial direction by fitting the annular projection portion 11*e* into a recess portion of the annular irregular portion 12*p* of the cover 12. A position in the forward-rearward direction of the rear end 11*j* of the filling unit 11 engaging with the cover 12 in the axial direction substantially coincides with a position in the forward-rearward direction of the rear end 12*m* of the cover 12 (or located slightly forward of the rear end 12*m*).

Then, in the wiper 13 mounted on the filling unit 11, the annular surface 13*v* and the inclined surface 13*w* of the second protruding portion 13*c* enters the bending portion 12*h* and the inclined surface 12*j* of the wall portion 12*d*. In this manner, the wiper 13 is pressed against the cover 12 in the axial direction, and closely adheres to the wall portion 12*d*. The outer surface of the extension portion 13*a*, which is the portion excluding the first protruding portion 13*b* of the wiper 13, closely adheres to the inner surface 11*a* of the filling unit 11 in an airtight state. The wiper 13 mounted on the filling unit 11 in this way is pressed against the cover 12 in the axial direction. In this manner, the first protruding portion 13*b* of the wiper 13 is interposed between each of the plurality of wall portions 12*d* and one end 11*g* on the opening 11*h* side of the filling unit 11 in the axial direction. The first protruding portion 13*b* closely adheres to the inner surface 12*q* of the cover 12 in an airtight state.

Referring to FIGS. 2 and 5, an example procedure for feeding the bar-shaped application material M of the application container 1 will be described. In the application container 1, in an initial state illustrated in FIG. 2, the cap C is removed, and the leading cylinder 3 is exposed. Thereafter, the leading cylinder 3 and the coupling cylinder 5 are rotated relative to each other in one direction (for example, clockwise) which is a feeding direction of the bar-shaped application material M. If the leading cylinder 3 and the coupling cylinder 5 are rotated relative to each other in one direction, the moving body 7 synchronously rotated with respect to the leading cylinder 3 and the holding member 8 synchronously rotated with respect to the coupling cylinder 5 are rotated relative to each other in one direction.

As a result of this relative rotation, the leading cylinder 3 and the middle cylinder 4 are rotated relative to each other. Accordingly, the relative rotation may be achieved using rotational torques corresponding to rotational resistance applied between the leading cylinder 3 and the middle cylinder 4. In addition, a screwing operation is performed in the screw portion 20 including the male screw 7*j* of the moving body 7 and the spiral projection 8*d* of the holding member 8. The groove portion 7*c* of the moving body 7 and the ridge 3*k* of the inner surface of the leading cylinder 3 function as a detent for the moving body 7 against the leading cylinder 3, and the holding member 8 is restricted in moving rearward to the coupling cylinder 5. Accordingly, the moving body 7 slides forward to the leading cylinder 3 due to the above-described relative rotation. In this way, if the application material holder 9 moves forward toward the leading cylinder 3 together with the moving body 7, the bar-shaped application material M appears from the opening 3*b* of the leading end of the leading cylinder 3, thereby bringing the bar-shaped application material M into a usable state.

An example operation associated with the application container 1 will now be described in detail. As illustrated in FIGS. 2, 17A and 17B, in the application container 1, the cylindrical filling unit 11 having the opening 11*h* in one end 11*g* in the axial direction is accommodated in the cylindrical cover 12, and has a double cylindrical shape. The female screw 12*e* is formed on one end side of the inner surface 12*q* of the cover 12 in the axial direction, and the male screw 6*h* is formed in the main body 2 (attachment member 6) having the application tool P to be inserted into the filling unit 11. In a state where the application tool P is inserted into the filling unit 11, the male screw 6*h* of the main body 2 is screwed into the female screw 12*e* of the inner surface 12*q* of the cover 12. In this manner, the main body 2 is mounted on the cover 12.

The wiper 13 formed of a soft material is fixed to the opening 11*h* of the filling unit 11 and the inner surface 12*q* of the cover 12. The wiper 13 includes the first protruding portion 13*b* protruding outward in the radial direction. The inner surface 12*q* of the cover 12 has the wall portions 12*d*. The first protruding portion 13*b* of the wiper 13 is interposed in the axial direction between the wall portions 12*d* and an end portion (one end 11*g*) on the opening 11*h* side of the filling unit 11. The first protruding portion 13*b* is fixed in a state of being interposed between the wall portion 12*d* of the inner surface 12*q* of the cover 12 and one end 11*g* on the opening 11*h* side of the filling unit 11.

Therefore, the first protruding portion 13*b* of the wiper 13 is interposed in the axial direction between the wall portion 12*d* of the inner surface 12*q* of the cover 12 and one end 11*g* of the filling unit 11. Accordingly, a configuration can be adopted so that the force acting in the axial direction is less likely to be applied to the first protruding portion 13*b* of the wiper 13. That is, the wiper 13 may be protected from the force acting in the axial direction. As a result, the position of the wiper 13 may be prevented from being misaligned with the inner surface 12*q* of the cover 12 and the filling unit 11. Therefore, the wiper 13 can be prevented from being detached.

The wiper 13 has the second protruding portion 13*c* protruding (forward) in the axial direction from the face on the cover 12 side (wall portion 12*d* side). The second protruding portion 13*c* enters the wall portion 12*d* in the axial direction. Therefore, the second protruding portion 13*c* may be prevented from slipping out of the wall portion 12*d*. Accordingly, the wiper 13 may be prevented from being detached. Even if the force acting inward in the radial direction is applied to the second protruding portion 13*c*, the wall portion 12*d* inhibits the second protruding portion 13*c* from moving inward in the radial direction. Accordingly, the second protruding portion 13*c* may be prevented from slipping inward in the radial direction from the wall portion 12*d*. As a result, the wiper 13 may be reliably prevented from being detached. In some examples, the second protruding portion 13*c* protrudes in the axial direction as the second protruding portion 13*c* is oriented outward in the radial direction. However, the shape of the second protruding portion is not limited to the shape of the second protruding portion 13*c*. For example, the second protruding portion may protrude in a rectangular shape in the axial direction.

The plurality of wall portions 12*d* may be disposed along the circumferential direction on the inner surface 12*q* of the cover 12. In this manner, the wall portions 12*d* are intermittently disposed along the circumferential direction on the inner surface 12*q* of the cover 12. Accordingly, the wall thickness of the cover 12 is relatively constant. Therefore, a so-called sink mark may be prevented from appearing when the cover 12 is manufactured by means of molding. The first protruding portion 13*b* of the wiper 13 can be interposed between the plurality of wall portions 12*d* and one end 11*g* of the filling unit 11. Therefore, even in a case where the plurality of wall portions 12*d* are intermittently formed along the circumferential direction, the wiper 13 may be reliably prevented from being detached.

As illustrated in FIGS. 2 and 5, the application container 1 includes the bar-shaped application material M extending in the axial direction on the side opposite to the application tool P of the main body 2. The main body 2 includes the feeding mechanism 15 for feeding the bar-shaped application material M in the axial direction. In this way, in the application container 1, the filling unit 11 is internally filled with the liquid or powder application material A, and the application container 1 includes the bar-shaped application material M. Accordingly, one application container 1 can be provided with a plurality of application materials. The main body 2 includes the feeding mechanism 15 for feeding the bar-shaped application material M on the side opposite to the application tool P of the main body 2. In this manner, the bar-shaped application material M can be fed to the side opposite to the application tool P.

The main body 2 includes the cylindrical attachment member 6 to which the application tool P is attached, and the stirring member S is disposed inside the attachment member 6. The stirring member S collides with the inner surface of the attachment member 6 in accordance with vibrations of the main body 2, thereby emitting collision sound. In this way, since the stirring member S emits the collision sound in accordance with the vibrations, a user of the application container 1 may be encouraged to vibrate the application container 1. For example, the user may be encouraged to vibrate the application container 1 by utilizing a characteristic that the user wants to shake the application container 1 if the user hears the collision sound of the stirring member S. Therefore, the vibrations of the application container 1 can encourage the user to stir the application material A by using the stirring member S.

The wiper 13 is formed of the rubber material, and in some example the hardness of the wiper 13 is set to 40 to 80 in accordance with a type A durometer regulated in JIS 6253 (method of obtaining hardness of vulcanized rubber and thermoplastic rubber). Accordingly, the hardness of the wiper 13 is suitable for the attachment member 6 and the application tool P. Accordingly, the attachment member 6 and the application tool P can be pulled while a proper elastic force is applied from the wiper 13 to the attachment member 6 and the application tool P. Therefore, the attachment member 6 and the application tool P can be drawn using a proper force.

Second Group of Embodiments

Next, an application container according to a second group of embodiments will be described with reference to FIGS. 18A, 18B, 19A, and 19B. In the second group of embodiments, a configuration of a cover 22 is different from the cover 12 according to the first group of embodiments. Hereinafter, in order to avoid repeated description, elements repeated from the first group of embodiments will be appropriately omitted in description.

The front side of the inner surface 12*q* of the cover 22 has a wall portion 22*d* protruding inward in the radial direction. For example, one wall portion 22*d* is disposed therein, and is formed on the entire periphery along the circumferential direction of the cover 22. In some examples, the expression "wall portion formed on the entire periphery along the circumferential direction" may be understood to include both a wall portion extending throughout the entire circumferential direction and a wall portion extending throughout the entire circumferential direction and having an intermittent portion in the circumferential direction. That is, the "wall portion formed on the entire periphery along the circumferential direction" may include a wall portion having a portion which does not protrude in the circumferential direction on the inner surface of the cover.

The wall portion 22*d* has an inner surface 22*g* extending in a direction away from an outer surface 22*a* of the cover 22 as the inner surface 22*g* is oriented rearward (inner side of the outer surface 22*a* in the radial direction and in a direction in which the cover 22 becomes thicker). Additionally, the wall portion 22*d* may include a bending portion 22*h* folded outward in the radial direction and forward from the rear end of the inner surface 22*g*, an inclined surface 22*j* obliquely extending outward in the radial direction and forward from the bending portion 22*h*, and a flat portion 22*k* extending further outward in the radial direction from an end portion outside in the radial direction of the inclined surface 22*j*. The inner surface 22*g* extends along the axis L, and extends parallel to the axis L, for example. However, the inner surface 22*g* may not extend parallel to the axis L. For example, the inner surface 22*g* may be inclined in a direction away from the axis L as the inner surface 22*g* is oriented rearward. Similar to the first group of embodiments, the wiper 13 mounted on the filling unit 11 is pressed against the cover 22 in the axial direction (forward), the first protruding portion 13*b* of the wiper 13 is interposed in the axial direction between the wall portion 22*d* and one end 11*g* of the filling unit 11.

In the application container according to the second group of embodiments, the first protruding portion 13*b* is fixed in a state of being interposed in the axial direction between the wall portion 22*d* of the inner surface 12*q* of the cover 22 and one end 11*g* on the opening 11*h* side of the filling unit 11. Therefore, a configuration can be adopted so that the force acting in the axial direction is less likely to be applied to the first protruding portion 13*b* of the wiper 13. Accordingly, the position of the wiper 13 may be prevented from being misaligned with the inner surface 12*q* of the cover 22 and the filling unit 11. As a result, the wiper 13 may be prevented from being detached, similar to other examples described herein.

According to the second group of embodiments, the wall portion 22*d* extends throughout the circumferential direction of the cover 22 on the inner surface 12*q* of the cover 22. Accordingly, a large contact area of the wall portion 22*d* in contact with the wiper 13 (second protruding portion 13*c*) can be secured. Therefore, the wiper 13 may be reliably prevented from being detached, and the wiper 13 may be further made airtight.

Third Group of Embodiments

Subsequently, an application container according to a third group of embodiments will be described with reference to FIGS. 20A, 20B, 21A, and 21B. In the third group of embodiments, each configuration of a cover 32 and a wiper 33 is different from that according to the second group of embodiments. Hereinafter, elements repeated from the respective embodiments will be appropriately omitted in description.

Similar to the cover 22, the cover 32 includes a wall portion 32*d*, and the wall portion 32*d* is formed on the entire periphery of the cover 32 in the circumferential direction. The wall portion 32*d* includes an inner surface 32*g* extending in a direction away from an outer surface 32*a* of the cover 32 as the inner surface 32*g* is oriented rearward, a bending portion 32*h* bent outward in the radial direction from the rear end of the inner surface 32*g*, and a flat surface 32*k* extending outward in the radial direction from the bending portion 32*h*. For example, an angle of the flat surface 32*k* with respect to the axial direction is 90°. Similar to the inner surface 22*g*, the inner surface 32*g* extends along the axis L. For example, the inner surface 32*g* may extend parallel to the axis L. Alternatively, the inner surface 32*g* may be inclined in a direction away from the axis L as the inner surface 32*g* is oriented rearward.

The wiper 33 is different from the wiper 13 in that the wiper 33 does not have a portion corresponding to the second protruding portion 13*c*. The wiper 33 has a first protruding portion 33*b* which protrudes outward in the radial direction in the front end of the extension portion 13*a*. The first protruding portion 33*b* has a protruding surface 33*s* extending outward in the radial direction from the front end of the extension portion 13*a*, an outer peripheral surface 33*e* extending forward from an end portion and outside in the radial direction of the protruding surface 33*s*, and an annular surface 33*v* extending inward in the radial direction from the front end of the outer peripheral surface 33*e*. For example, the angle of the annular surface 33*v* with respect to the outer peripheral surface 33*e* is the same as the angle of the flat surface 32*k* with respect to the axial direction, and is set to 90°.

In some examples, the wiper 33 is mounted on the filling unit 11, and the wiper 33 mounted on the filling unit 11 is pressed against the cover 32 in the axial direction. The first protruding portion 33*b* of the wiper 33 is interposed in the axial direction between the wall portion 32*d* and one end 11*g* of the filling unit 11. In some examples, the outer peripheral surface 33*e* of the first protruding portion 33*b* closely adheres to the inner surface 12*q* of the cover 32, one end 11*g* comes into contact with the protruding surface 33*s*, and the flat surface 32*k* of the wall portion 32*d* comes into contact with the annular surface 33*v*.

In the application container according to the third group of embodiments, the first protruding portion 33*b* is fixed in a state of being interposed in the axial direction between the wall portion 32*d* of the cover 32 and one end 11*g* of the filling unit 11. Accordingly, a configuration can be adopted so that the force acting in the axial direction is less likely to be applied to the first protruding portion 33*b*. Therefore, the position of the wiper 33 may be prevented from being misaligned with the cover 32 and the filling unit 11. Accordingly, the wiper 33 may be prevented from being detached.

Hitherto, respective example embodiments of the application container have been described. However, the example embodiments may be modified within the scope of the present disclosure. For example, in the above-described first to third groups of embodiments, the cover and the wiper which are provided with various shapes have been described. However, each shape of the cover and the wiper can be further changed. In addition, changes in a size, a material, and an arrangement aspect of the cover and the wiper may be appropriately made, and changes in a shape, a size, a material, and an arrangement aspect of the filling unit may also be appropriately made.

The bar-shaped application material M has been described which includes the inclined portion M1, the pair of flat surface M2, and the side surface M3 extending in the axial direction as illustrated in FIG. 5. However, the shape, the size, the material, and the arrangement aspect of the bar-shaped application material can be appropriately changed. Furthermore, in some of the above-described examples, the main body 2 has been described which includes the leading cylinder 3, the middle cylinder 4, the coupling cylinder 5, the attachment member 6, the moving body 7, the holding member 8, and the application material holder 9. However, the configuration of the components forming the main body can be appropriately changed. In addition, the shape, the size, the material, and the arrangements aspect of the leading cylinder, the middle cylinder, the coupling cylinder, the attachment member, the moving body, the holding member, and the application material holder can also be appropriately changed.

What is claimed is:

1. An application container comprising:

a cylindrical filling unit that has an opening in one end in an axial direction;

a cover that has a cylindrical shape for accommodating the filling unit, and that has a female screw formed at one end of the cover in the axial direction;

a main body that has an application tool that is configured to be inserted into the filling unit, and a male screw that is configured to be screwed into the female screw; and a soft material wiper that is fixed to the opening of the filling unit, wherein the wiper has a first protruding portion which protrudes outward from the opening in a radial direction of the filling unit to contact an inner surface of the cover, wherein the first protruding portion is interposed in the axial direction between a wall portion disposed on the inner surface of the cover and the end of the filling unit which includes the opening, and wherein the wiper has a second protruding portion which protrudes in the axial direction towards the end of the cover which includes the female screw.

2. The application container according to claim 1, wherein a plurality of wall portions are disposed on the inner surface of the cover along a circumferential direction of the cover.

3. The application container according to claim 1, further comprising:

a bar-shaped application material that is located at an opposite end of the main body from the application tool, wherein the main body includes a feeding mechanism which feeds the bar-shaped application material in the axial direction.

4. The application container according to claim 1, wherein the cover is removably connectable to the main body via the female screw, and wherein the application tool is removed from the fitting unit through the wiper when the cover is removed from the main body.

5. An application container comprising:

a cylindrical filling unit that has an opening in one end in an axial direction;

a cover that has a cylindrical shape for accommodating the filling unit, and that has a female screw formed at one end of the cover in the axial direction;

a main body that has an application tool that is configured to be inserted into the filling unit, and a male screw that is configured to be screwed into the female screw; and a soft material wiper that is fixed to the opening of the filling unit, wherein the wiper has a first protruding portion which protrudes outward from the opening in a radial direction of the filling unit to contact an inner surface of the cover, wherein the first protruding portion is interposed in the axial direction between a wall portion disposed on the inner surface of the cover and the end of the filling unit which includes the opening, and wherein a plurality of wall portions are disposed on the inner surface of the cover along a circumferential direction of the cover.

6. The application container according to claim 5, further comprising:

a bar-shaped application material that is located at an opposite end of the main body from the application tool, wherein the main body includes a feeding mechanism which feeds the bar-shaped application material in the axial direction.

7. The application container according to claim 5, wherein the filling unit and the wiper are fixed to the cover to form a unitary accommodation portion that is removable from the main body via the female screw of the cover.

8. An application container comprising:

a main body having an application tool to apply an application material; and an accommodation portion to accommodate the application material, wherein the accommodation portion is removably connectable to the main body, and wherein the accommodation portion includes:

a cover that extends in a longitudinal direction, wherein the cover includes an open end to receive the application tool of the main body, a longitudinal wall that extends substantially in the longitudinal direction, and an inner wall portion that extends inwardly from the longitudinal wall;

a filling unit that is fixed inside the cover, wherein the filling unit extends in the longitudinal direction inside the cover, wherein the filling unit includes a first end forming an opening to receive the application tool and a second end opposite the first end; and a wiper that is at least partially located between the first end of the filling unit and the inner wall portion of the cover, in the longitudinal direction, wherein the wiper includes a protrusion that extends from the opening at the first end of the filling unit, outwardly toward the longitudinal wall of the cover, and wherein the protrusion is interposed in the longitudinal direction between the first end of the filling unit and the inner wall portion of the cover.

9. The application container according to claim 8, wherein the wiper is mounted at the opening formed at the first end of the filling unit.

10. The application container according to claim 8, comprising a plurality of inner wall portions including the inner wall portion, wherein the plurality of inner wall portions are arranged along an inner periphery of the cover to position the protrusion of the wiper between the plurality of inner wall portions and the filling unit.

11. The application container according to claim 8, wherein the protrusion includes a first protruding portion that extends from the opening at the first end of the filling unit in a lateral direction that is orthogonal to the longitudinal direction toward the longitudinal wall of the cover, and a second protruding portion that extends from the first protruding portion in the longitudinal direction toward the opening of the cover.

12. The application container according to claim 11, wherein the inner wall portion of the cover extending from the longitudinal wall includes an inclined surface that extends inwardly away from the open end of the cover, to engage the second protruding portion of the wiper.

13. The application container according to claim 12, wherein the second protrusion includes an inclined surface to contact the inclined surface of the inner wall portion of the cover.

14. The application container according to claim 8, wherein the wiper includes an inward extension portion that extends from the first end of the filling unit inwardly into the opening of the filling unit to form a through-hole for the application tool of the main body.

15. The application container according to claim 8, wherein the second end of the filling unit is closed so as to form a container to store the application material.

16. The application container according to claim 8, wherein the filling unit includes a longitudinal inner surface that extends substantially linearly in the longitudinal direction, from the first end to the second end of the filling unit.

17. The application container according to claim 8, wherein the wiper is recessed relative to the open end of the cover, in the longitudinal direction.

18. The application container according to claim 17, wherein the main body includes a first screw thread, and wherein the cover includes a second screw thread located between the wiper and the open end, to engage the first screw thread on the main body.

19. The application container according to claim 8, wherein the wiper includes a flexible material.

* * * * *